US012595986B2

(12) United States Patent
Gringauz

(10) Patent No.: US 12,595,986 B2
(45) Date of Patent: Apr. 7, 2026

(54) CORRECTING TARGETING OF INDIRECT FIRE

(71) Applicant: TRAJECTAL LTD., Meitar (IL)

(72) Inventor: Michael Gringauz, Meitar (IL)

(73) Assignee: TRAJECTAL LTD., Meitar (IL)

( * ) Notice: Subject to any disclaimer, the term of this patent is extended or adjusted under 35 U.S.C. 154(b) by 0 days.

(21) Appl. No.: 19/108,204

(22) PCT Filed: Sep. 11, 2023

(86) PCT No.: PCT/IL2023/050975
§ 371 (c)(1),
(2) Date: Mar. 3, 2025

(87) PCT Pub. No.: WO2024/057303
PCT Pub. Date: Mar. 21, 2024

(65) Prior Publication Data

US 2025/0341384 A1 Nov. 6, 2025

(30) Foreign Application Priority Data

Sep. 13, 2022 (IL) ..... 296452

(51) Int. Cl.
*F41G 11/00* (2006.01)
*F41G 3/04* (2006.01)
(Continued)

(52) U.S. Cl.
CPC ..... *F41G 3/142* (2013.01); *F41G 3/04* (2013.01); *F41G 3/08* (2013.01); *F41G 3/12* (2013.01)

(58) Field of Classification Search
CPC ... F41G 3/142; F41G 3/04; F41G 3/08; F41G 3/12; F41G 11/00; F41G 7/34; F42B 15/01; G01C 25/005
See application file for complete search history.

(56) References Cited

U.S. PATENT DOCUMENTS 4,405,985 A * 9/1983 Hall ..... F41G 7/34 701/507
10,739,109 B1 * 8/2020 Tello ..... F41G 3/08
(Continued)

OTHER PUBLICATIONS

PCT International Search Report for International Application No. PCT/IL2023/050975, mailed Dec. 10, 2023, 3pp.
(Continued)

*Primary Examiner* — Jamara A Franklin
(74) *Attorney, Agent, or Firm* — The Roy Gross Law Firm, LLC; Roy Gross

(57) ABSTRACT

A system and method are provided for correcting targeting of indirect fire, including: acquiring values for a set of firing conditions, for each of the firing conditions determining statistical parameters of a covariance matrix of the firing conditions, including estimates of unit effects, standard deviations, and error correlations between registration and fire-for-effect (FFE) firing condition errors, wherein at least one correlation is less than one and greater than zero, acquiring a registration miss vector, generating from the statistical parameters a conditional correction matrix; and multiplying the conditional correction matrix by the registration miss vector to calculate a correction vector for FFE targeting.

20 Claims, 13 Drawing Sheets

(51) Int. Cl.

| | |
|---|---|
| ***F41G 3/08*** | (2006.01) |
| ***F41G 3/12*** | (2006.01) |
| ***F41G 3/14*** | (2006.01) |

(56) References Cited

U.S. PATENT DOCUMENTS

| | | | |
|---|---|---|---|
| 2012/0048931 | A1 | 3/2012 | Arbouw |
| 2018/0340779 | A1 | 11/2018 | Faulkner et al. |
| 2022/0163291 | A1 | 5/2022 | Mcneil et al. |

OTHER PUBLICATIONS

PCT Written Opinion for International Application No. No. PCT/IL2023/050975, mailed Dec. 10, 2023, 4pp.

Bendersky, et al., Fire support with Gaussian estimation of environmental conditions based on single or multiple target registration, Journal of the Operational Research Society, vol. 72, 2021—Issue 9, pp. 2112-2121.doi: 10.1080/01605682.2020.1772017.

Robert L. McCoy, Modern Exterior Ballistics: The Launch and Flight Dynamics of Symmetric Projectiles, Schiffer Military, 2009.

Eaton, Morris L. Multivariate Statistics: A Vector Space Approach, (1983) John Wiley and Sons. pp. 116-117.

North Atlantic Treaty Organization (NATO): STANAG 4061 MET, Edition 4—Adoption Of A Standard Ballistic Meteorological Message, Military Agency For Standardization, 1110 Brussels, Mar. 10, 2000, 4pp. (Abstract).

* cited by examiner

Table: Summary of error factors for main firing conditions

| Category of Firing Condition | Firing Condition | Error source | Correlation decreases over time? | Correlation estimation between registration and FFE needed: |
|---|---|---|---|---|
| Environmental (Meteorology) | Wind (N, E speed vectors) | Meteorology measurement, geographical region | Yes | height of trajectory changes, time delay, guns at different location |
| | Air pressure | Same as above | Yes | Same as above |
| | Air temperature | Same as above | Yes | Same as above |
| Ballistic (gun) | Projectile mass | Projectile type | No | No correlation (corr=0) between lots |
| | Drag ballistic coefficient | Projectile type | No | Same as above |
| | Lift ballistic coefficient | Projectile type | No | Same as above |
| Muzzle velocity (gun) | Charge | Projectile type, propellant type, charge value | No | Changing charge |
| | Barrel wear | Type of gun | No | No correlation (corr=0) between guns |
| | Ammunition lot | Projectile type | No | No correlation (corr=0) between manufacturing lots |
| | Propellant lot | Projectile type, propellant type, charge value | No | No correlation (corr=0) between manufacturing lots |
| | Propellant temperature | Projectile type, propellant type, charge value | Yes | Changing charge, time passed since registration |
| Aiming (gun) | Elevation setting accuracy | Type of gun | No | Changing guns |
| | Elevation jump | Type of gun | No | Changing guns, changing charge |
| | Azimuth setting accuracy | Type of gun | No | Changing guns |
| | Azimuth jump | Type of gun | No | Changing guns, changing charge |
| Location | Gun location | Navigation system | No | Changing guns |
| | Target location | Spotting system | No | Not needed |

FIG. 3

Table: Feasibility of firing with CVC correction and remaining error of all combinations

| Gun | Charge | Trajectory | RMSE (remaining error) [m] | CVC correction vector [m] | Feasible? |
|---|---|---|---|---|---|
| 1 | 1 | high | 51 | (-110, -230) | Yes |
| 1 | 2 | high | 50 | (-80, -250) | Yes |
| 1 | 3 | high | - | - | NO |
| 1 | 1 | low | 40 | (-95, -200) | Yes |
| 1 | 2 | low | 45 | (-115, -205) | Yes |
| 1 | 3 | low | 55 | (-117, -220) | Yes |
| 2 | 1 | high | - | - | NO |
| 2 | 2 | high | 65 | (-105, -190) | Yes |
| 2 | 3 | high | 72 | (-100, -197) | Yes |
| 2 | 1 | low | - | - | NO |
| 2 | 2 | low | 35 | (-130, -221) | Yes |
| 2 | 3 | low | 42 | (-117, -217) | Yes |
| 3 | 1 | high | - | - | NO |
| 3 | 2 | high | 80 | (-111, -230) | Yes |
| 3 | 3 | high | 90 | (-99, -213) | Yes |
| 3 | 1 | low | - | - | NO |
| 3 | 2 | low | 75 | (-100, -200) | Yes |
| 3 | 3 | low | 77 | (-115, -232) | Yes |

FIG. 4

Table: Remaining error of filtered combinations, sorted by RMSE

| Gun | Charge | Trajectory | RMSE (remaining error) [m] | CVC correction vector [m] | Feasible |
|---|---|---|---|---|---|
| 2 | 2 | low | 35 | (-130, -221) | Yes |
| 1 | 1 | low | 40 | (-95, -200) | Yes |
| 2 | 3 | low | 42 | (-117, -217) | Yes |
| 1 | 2 | low | 45 | (-115, -205) | Yes |
| 1 | 2 | high | 50 | (-80, -250) | Yes |
| 1 | 1 | high | 51 | (-110, -230) | Yes |
| 1 | 3 | low | 55 | (-117, -220) | Yes |
| 2 | 2 | high | 65 | (-105, -190) | Yes |
| 2 | 3 | high | 72 | (-100, -197) | Yes |
| 3 | 2 | low | 75 | (-100, -200) | Yes |
| 3 | 3 | low | 77 | (-115, -232) | Yes |
| 3 | 2 | high | 80 | (-111, -230) | Yes |
| 3 | 3 | high | 90 | (-99, -213) | Yes |

FIG. 5

Use case 4 – same trajectory and charge, different gun locations, registration and FFE are at the same location.

1100

1200

Use case 7 – multiple guns are firing for FFE, optimal charge to use for gun (battery) 3 for each FFE target on the grid

1300

CORRECTING TARGETING OF INDIRECT FIRE

CROSS REFERENCES TO RELATED APPLICATIONS

This application is a National Phase of PCT Patent Application No. PCT/IL2023/050975 having International filing date of Sep. 11, 2023, which claims the benefit of priority of Israeli Patent Application No. 296452, filed Sep. 13, 2022, the contents of which are all incorporated herein by reference in their entirety.

FIELD OF THE INVENTION

The present invention generally relates to the field of military operations, in particular for executing indirect fire.

BACKGROUND

Modern military operations demand effective, long range, indirect fire delivery. To be successful, such operations require that firing conditions be accurately calibrated, which typically means that fire should first be directed towards a "registration" target before being directed towards a desired target (referred to herein as the "fire-for-effect" target).

There are several types of registration techniques, all of which aim to determine a correction factor for firing towards the FFE target. In mean point of impact (MPI) registration, a number of rounds with the same set of firing conditions (e.g., same gun, same charge, same position) are fired at a registration location to determine the total miss at a known point. Similarly, in "offset registration," also referred to as "registration to the rear," registration firing is conducted by one gun (or "howitzer"), which provides calibration data to other guns in the unit.

A more recent registration method is described by Bendersky, et al., in "*Fire support with Gaussian estimation of environmental conditions based on single or multiple target registration*, Journal of the Operational Research Society, Volume 72, 2021—Issue 9, pp 2112-2121 (hereinbelow, "Bendersky"). The method described by Bendersky is referred to as conditional vector correction, hereinbelow "CVC". The method applies a multivariate normal distribution of systematic firing errors and their conditional marginal distribution to estimate the most probable values of the environmental and the system intrinsic error values. Given empirical knowledge about the distribution characteristics of these errors and the miss vector obtained after firing one or more registration shots, a correction for FFE firing is generated.

The various registration methods yield corrections such as range, deflection, and charge corrections that may applied to calibrating gun fire towards the FFE.

Current registration and fire calibration techniques have various limitations, regarding accuracy and availability, as well as reducing the element of surprise due to close registration firings. Registration corrections are valid only within certain limits of range and deflection. Assessing such limits accurately is also important for effective operations.

SUMMARY

Embodiments of the present invention provide a system and methods for correcting targeting of indirect fire. Embodiments include a system performing steps of:

1) acquiring location coordinates of a) a gun to be fired for registration, of b) a registration target, and of c) a fire-for-effect (FFE) target;
2) acquiring values for a set of firing conditions, including gun and/or environmental conditions, for both registration and FFE firing, wherein the set of firing conditions include one or more of projectile mass, ballistic drag and lift coefficients, muzzle velocity, barrel wear, propellant temperature, elevation jump, azimuth jump, wind velocity, air pressure, air temperature;
3) estimating a unit effect of a firing condition error, for each of the firing conditions of the set, and determining correlation terms of an error covariance matrix W, wherein the correlation terms indicate correlations between errors both of registration firing conditions and of FFE firing conditions, and wherein at least one correlation term is less than one and greater than zero;
4) acquiring a registration miss vector as a result of firing the gun for registration firing, wherein elevation and azimuth parameters for registration firing are calculated by a ballistic simulation engine (BSE);
5) generating from the correlation terms of the error covariance matrix W and the unit effects, 1) an effects covariance matrix $\Sigma_{12}$ of effect correlations between errors of conditions during registration fire and errors of conditions during FFE, and 2) an effects covariance matrix $\Sigma_{22}$ of correlations between errors of conditions during FFE, and responsively calculating a conditional correction matrix $\Sigma_{12}\Sigma_{22}^{-1}$; and
6) multiplying the conditional correction matrix by the registration miss vector to calculate an FFE correction vector for FFE firing.

BRIEF DESCRIPTION OF DRAWINGS

For a better understanding of various embodiments of the invention and to show how the same may be carried into effect, reference will now be made, by way of example, to the accompanying drawings. Structural details of the invention are shown to provide a fundamental understanding of the invention, the description, taken with the drawings, making apparent to those skilled in the art how the several forms of the invention may be embodied in practice. In the figures:

FIG. 3 is a table presenting a list of firing conditions and their error estimations, in accordance with an embodiment of the present invention.

FIGS. 4 and 5 are tables of residual, root mean square errors (RMSEs) for target correction for different fire conditions, in accordance with embodiments of the present invention;

DETAILED DESCRIPTION

Embodiments of the present invention provide a system and methods for correcting targeting of indirect fire.

Figure 1:
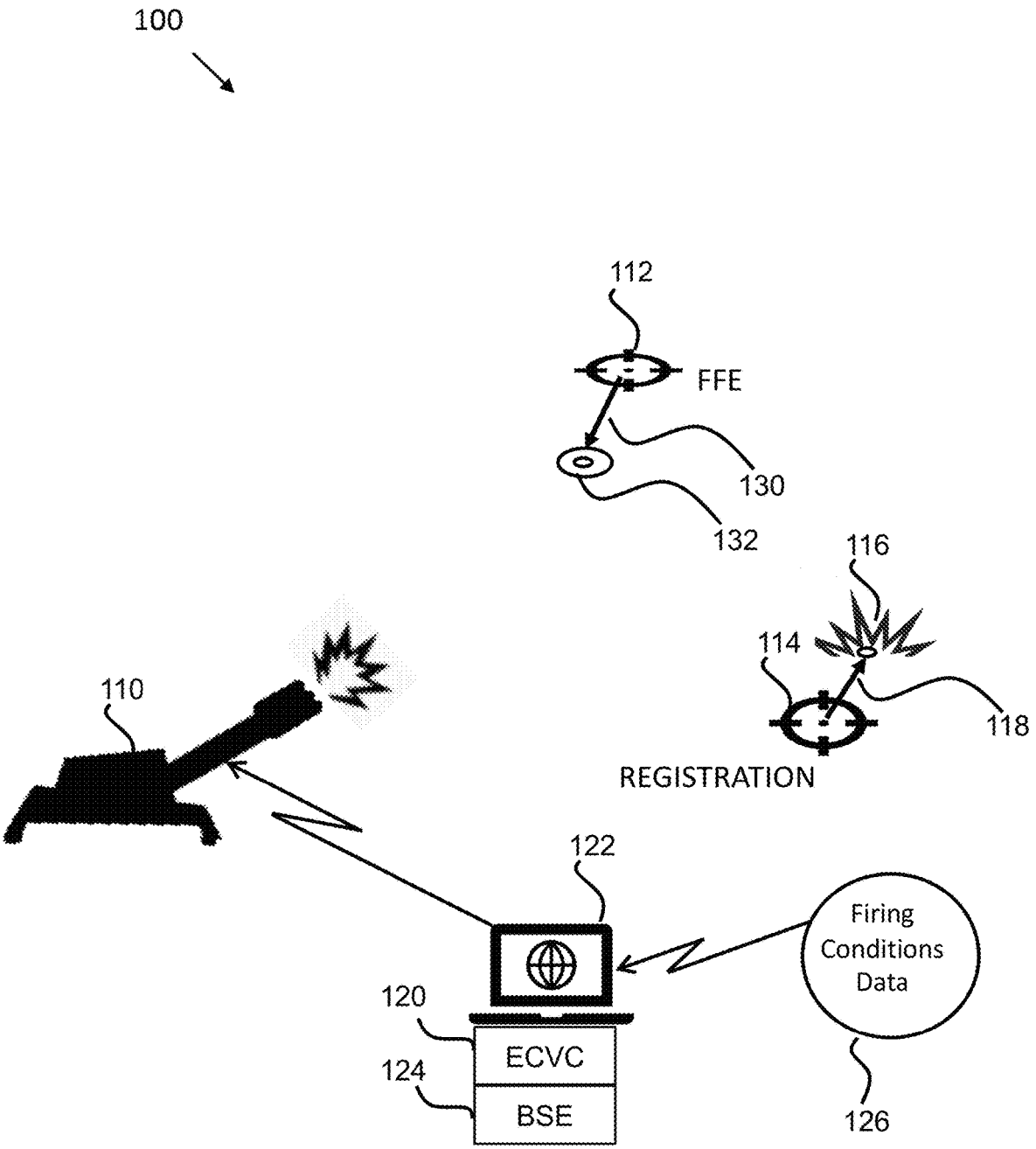
FIG. 1 is a schematic diagram of an operational environment of a system for correcting targeting of indirect fire, in accordance with embodiments of the present invention.

FIG. 1 is a schematic diagram of a system 100 providing indirect fire. One or more guns 110 are positioned to provide indirect fire to hit fire-for-effect (FFE) target coordinates 112. The guns may be cannons or any other type of artillery or rocket launching mechanism used by military field units. Before firing towards the FFE target, firing towards a registration target 114 is undertaken. Impact occurs at a site 116, whose coordinates are offset from the registration target coordinates by a registration miss vector 118 (also referred to herein as a "deviation" vector). The value of the registration miss vector 118 is entered to an "error-correlated CVC module," indicated as ECVC module 120 (also referred to herein as the "improved CVC"). The ECVC calculates a vector for correcting FFE targeting, as described further hereinbelow. The ECVC module 120 is configured to run on a processor such as computer 122. Also configured to run on computer 122 or an associated computer is a module referred to as a ballistics simulation engine (BSE) 124, also referred to herein as a ballistic trajectory simulator. One form of BSE that is widely used is known as a modified point mass trajectory (MPMT) model, such as is described in *MODERN EXTERIOR BALLISTICS: The Launch and Flight Dynamics of Symmetric Projectiles*, Robert L. McCoy, Schiffer Military, 2009.

Both the BSE 124 and the ECVC module 120 receive, as input, additional data related to firing conditions, indicated as firing conditions data 126. This input data of firing conditions may be manually entered and/or received from external systems, for example from field sensors, meteorological systems, and GPS systems. The input data may include "ballistic" or "gun" parameters such as charge, projectile mass, ballistic drag and lift coefficients, muzzle velocity, barrel wear, propellant temperature, elevation jump, and azimuth jump. Such parameters are usually obtained by any combination of firing tests, aerodynamic simulations, wind tunnel tests, and/or manufacturer-provided data. The firing conditions data 126 may also include environmental conditions such as wind velocity, air pressure, and air temperature. The data entered to the ECVC module also includes coordinates of the gun 110, of the registration target 114, and of the FFE target 112.

Types of firing conditions, as well as their associated measurement errors, both systematic and random, are described in the section of this Specification titled, "Firing Conditions and Derivation of Error Factors". (Random errors are errors that cannot be replicated; systematic errors are those that produce consistent results.)

The BSE 124 is typically used to set gun parameters (i.e., parameters for "aiming" the gun, typically azimuth and elevation) both when firing to the registration target and when firing to the FFE target. By processing that is known as "backward run," the BSE 124 can provide parameters of gun elevation, azimuth, and charge, based on input including desired hit point coordinates (target coordinates), as well as input including gun and environmental conditions (such as gun type and wind speed, as described further hereinbelow). The BSE 124 may also be configured to operate in what is referred to as "forward run," whereby the BSE determines hit point coordinates when given gun parameters (quadrant elevation, gun azimuth, charge) as well as gun and environmental conditions (e.g., gun type and wind speeds). The output of the forward run may include both target hit coordinates and a projectile trajectory (including a maximum height of the trajectory). The BSE forward run may be used, as described further hereinbelow, to determine unit effects of firing conditions.

As described hereinbelow, in embodiments of the present invention, the ECVC module 120 provides the BSE 124 with FFE target correction coordinates 132 that are offset from the intended target coordinates 112 by an FFE correction vector 130, based on error distributions of the firing conditions. In some implementations, the ECVC calculations may be implemented within a BSE software package. Alternatively, the two modules may execute separately, with automated or manual exchange of data.

ECVC Derivation

The following table provides a list of symbols and abbreviations used herein:

| | |
|---|---|
| Az, AZ | azimuth (relative to North) |
| QE | quadrant elevation |
| CVC | conditional vector correction |
| ECVC | enhanced CVC |
| DHD | did-hit data |
| FFE | fire for effect |
| KP | known point, for registration |
| MET | meteorology |
| MPI | mean point of impact |
| MPMT | modified-point mass trajectory simulation |
| MRSI | multi-round simultaneous impact |
| SHD | should-hit data |
| TOF | time of flight |
| $e_i$ | systematic firing error (i) |
| $\sigma_i$ | standard deviation of systematic firing error |
| $X_i$ | normalized systematic firing error |
| $\tau_i$ | standard deviation of random firing error |
| $X_{0,i}$ | Normalized gaussian systematic firing errors for registration target |
| $X_{1,i}$ | normalized normal systematic firing errors for FFE target |
| $Z^A$ | miss distance for registration target in east direction |
| $Z^B$ | miss distance for registration target in north direction |
| $Z^C$ | miss distance for FFE target in east direction |
| $Z^D$ | miss distance for FFE target in north direction |
| $\Sigma$, $\Sigma_{systematic}$, $\Sigma_{random}$ | miss point effects covariance matrix and its systematic and random error components |
| $\Sigma_{ij}$ | 2x2 blocks of the 4x4 effects covariance matrix $\Sigma$ |
| W | 2n x 2n error covariance matrix (of error components) |
| $u_j^A$, $u_j^B$ | unit effects at the registration target, east and north directions respectively |
| $u_j^C$, $u_j^D$ | unit effects at the FFE target, east and north directions respectively |
| t | time elapsed from the registration fire |
| $\sum_{12}\sum_{22}^{-1}$ | conditional correction matrix |
| $\vec{r}_{CVC}$ | CVC correction vector for FFE, equal to $\sum_{12}\sum_{22}^{-1}\begin{pmatrix} v \\ w \end{pmatrix}$, where $\begin{pmatrix} v \\ w \end{pmatrix}$ is vector of the registration miss from the registration target coordinates |
| $U_{CVC}$ | remaining error (covariance matrix of the conditional distribution of hits at FFE) of the CVC algorithm |
| $RMSE_{CVC}$ | single valued measure for remaining correction error |
| $n_0$ | group size (number of rounds fired) at the registration target |
| $n_1$ | group size (number of rounds fired) at the FFE target |

Basic CVC Background

As described above, the CVC method described by Bendersky (hereinbelow, the "basic CVC") applies a multivariate normal distribution of systematic firing errors and their conditional marginal distribution, together with a vector of a miss at the registration target, to generate adjusted coordinates of a fire-for-effect (FFE) target for applying to a ballistic simulation engine. The form of the basic CVC is described here, to clarify the differences between the basic CVC and the ECVC method of the present invention. The basic CVC assumes that measurement errors of firing conditions, i.e., systematic firing errors $e_1, e_2, \ldots, e_n$ are independently and normally distributed with expected value of 0:

$$e_i \sim N(0, \sigma_i) \tag{1}$$

Furthermore, the systematic errors are assumed identical for the registration and the FFE targets, within a single fire scenario. The systematic errors can therefore be written as:

$$e_i = \sigma_i X_i, \text{ where } X_i \sim N(0, 1) \tag{2}$$

Where $X_1, X_2, \ldots, X_n$ are the normalized systematic errors, which have normal distributions.

The miss vector at the registration target is denoted by east-north coordinates $(Z^A, Z^B)$ and the miss coordinates at the FFE target by $(Z^C, Z^D)$ in the same east-north coordinates. For each firing scenario and FFE target, a ballistic trajectory simulation (i.e., the BSE, as described above) is applied to determine the unit effects, that is, the partial derivatives of the miss vector for each error factor j (i.e., for each value of physical parameter during the firing):

$$\text{unit effect: } u_j^{A,B,C \text{ or } D} = \frac{\partial\left(Z^{A,B,C \text{ or } D}\right)}{\partial(e_j)} \tag{3}$$

The values of the miss vectors are functions of the unit effects, as follows:

$$\left(Z^A, Z^B\right) = \left(\sum_{j=1}^{n} a_j X_j, \sum_{j=1}^{n} b_j X_j\right) \text{ where } a_j = \sigma_j u_j^A,\ b_j = \sigma_j u_j^B \tag{4}$$

$$\left(Z^C, Z^D\right) = \left(\sum_{j=1}^{n} c_j X_j, \sum_{j=1}^{n} d_j X_j\right) \text{ where } c_j = \sigma_j u_j^C,\ d_j = \sigma_j u_j^D$$

Where $\sigma_1, \sigma_2, \ldots, \sigma_n$ are the systematic errors standard deviation values, which may be measured empirically as described further hereinbelow. Due to linearity, the random vector variable $(Z^A, Z^B, Z^C, Z^D)$ is distributed multivariate normally, with a 4×4 matrix of effects covariance $\Sigma$:

$$\left(Z^A, Z^B, Z^C, Z^D\right) \sim N\left((0, 0, 0, 0), \sum\right) \tag{5}$$

In the basic CVC calculation, effects covariance matrix $\Sigma$ is calculated assuming independence between different error components and assuming the equality of the same error components for the registration and FFE targets. That is, each element of the 4×4 effects covariance matrix is multiplied by a factor $E(X_i X_j)$ where:

$$E(X_i X_j) = \begin{cases} 1, & i = j \\ 0, & i \neq j \end{cases} \tag{6}$$

For example:

$$\left(Z^{A^2}\right) = E\left(\left(\sum_{j=1}^{n} a_j X_j\right)^2\right) = \sum_{i=1}^{n}\sum_{j=1}^{n} a_i a_j E(X_i X_j) = \sum_{j=1}^{n} a_j^2 \tag{7}$$

$$E\left(Z^A Z^D\right) = E\left(\sum_{j=1}^{n} a_j X_j \sum_{j=1}^{n} d_j X_j\right) = \sum_{i=1}^{n}\sum_{j=1}^{n} a_i d_j E(X_i X_j) = \sum_{j=1}^{n} a_j d_j$$

The final form of $\Sigma_{systematic}$ is:

$$\sum_{systematic} = \begin{pmatrix} \sum_{j=1}^{n} a_j^2 & \sum_{j=1}^{n} b_j a_j & \sum_{j=1}^{n} c_j a_j & \sum_{j=1}^{n} d_j a_j \\ \sum_{j=1}^{n} a_j b_j & \sum_{j=1}^{n} b_j^2 & \sum_{j=1}^{n} c_j b_j & \sum_{j=1}^{n} d_j b_j \\ \sum_{j=1}^{n} a_j c_j & \sum_{j=1}^{n} b_j c_j & \sum_{j=1}^{n} c_j^2 & \sum_{j=1}^{n} d_j c_j \\ \sum_{j=1}^{n} a_j d_j & \sum_{j=1}^{n} b_j d_j & \sum_{j=1}^{n} c_j d_j & \sum_{j=1}^{n} d_j^2 \end{pmatrix} \tag{8}$$

It is also possible to add a random error variation (error for a single shot) by adding a random error component of an effects covariance matrix:

$$\sum_{random} = \begin{pmatrix} \sum_{j=1}^{n} \frac{a_j'^2}{n_0} & \sum_{j=1}^{n} \frac{b_j'}{n_0} & 0 & 0 \\ \sum_{j=1}^{n} \frac{a_j' b_j'}{n_0} & \sum_{j=1}^{n} \frac{b_j'^2}{n_0} & 0 & 0 \\ 0 & 0 & \sum_{j=1}^{n} \frac{c_j'^2}{n_1} & \sum_{j=1}^{n} \frac{d_j' c_j'}{n_1} \\ 0 & 0 & \sum_{j=1}^{n} \frac{c_j' d_j'}{n_1} & \sum_{j=1}^{n} \frac{d_j'^2}{n_1} \end{pmatrix} \tag{9}$$

$$\text{where } a_j' = \tau_j u_j^A,\ b_j' = \tau_j u_j^B,\ c_j' = \tau_j u_j^C,\ d_j' = \tau_j u_j^D,$$

$\tau_j$ is the random error standard deviation value of factor j, and $n_0$ and $n_1$ are the number of rounds fired to registration and FFE targets respectively.

Finally, the total effects covariance matrix can be written in the form:

$$\Sigma = \sum_{systematic} + \sum_{random} = \begin{pmatrix} \sum_{11} & \sum_{12} \\ \sum_{21} & \sum_{22} \end{pmatrix} \tag{10a}$$

Where $\Sigma_{ij}$ are 2×2 matrix blocks:

$$\sum_{11} = \begin{pmatrix} \sum_{j=1}^{n} a_j^2 + \sum_{j=1}^{n} \frac{a_j'^2}{n_0} & \sum_{j=1}^{n} b_j a_j + \sum_{j=1}^{n} \frac{b_j' a_j'}{n_0} \\ \sum_{j=1}^{n} a_j b_j + \sum_{j=1}^{n} \frac{a_j' b_j'}{n_0} & \sum_{j=1}^{n} b_j^2 + \sum_{j=1}^{n} \frac{b_j'^2}{n_0} \end{pmatrix} \tag{10b}$$

$$\sum_{12} = \begin{pmatrix} \sum_{j=1}^{n} c_j a_j & \sum_{j=1}^{n} d_j a_j \\ \sum_{j=1}^{n} c_j b_j & \sum_{j=1}^{n} d_j b_j \end{pmatrix}$$

-continued $$\sum_{21} = \begin{pmatrix} \sum_{j=1}^{n} a_j c_j & \sum_{j=1}^{n} b_j c_j \\ \sum_{j=1}^{n} a_j d_j & \sum_{j=1}^{n} b_j d_j \end{pmatrix}$$

$$\sum_{22} = \begin{pmatrix} \sum_{j=1}^{n} c_j^2 + \sum_{j=1}^{n} \frac{c_j'^2}{n_1} & \sum_{j=1}^{n} d_j c_j + \sum_{j=1}^{n} \frac{d_j' c_j'}{n_1} \\ \sum_{j=1}^{n} c_j d_j + \sum_{j=1}^{n} \frac{c_j' d_j'}{n_1} & \sum_{j=1}^{n} d_j^2 + \sum_{j=1}^{n} \frac{d_j'^2}{n_1} \end{pmatrix}$$

From here, given a miss vector (v, w) at the registration target (i.e., $Z^A$=v, $Z^B$=w), the conditional marginal distribution of a miss vector at the FFE target ($Z^C$, $Z^D$|$Z^A$=v, $Z^B$=w) will also be normal. As derived in *Multivariate Statistics: A Vector Space Approach*, Eaton, Morris L. (1983) John Wiley and Sons. pp. 116-117 (hereinbelow, "Eaton"), and as applied by Bendersky, a conditional marginal distribution, given by ($Z^C$, $Z^D$|$Z^A$=v, $Z^B$=w), has an expected value of $$\sum_{12} \sum_{22}^{-1} \begin{pmatrix} v \\ w \end{pmatrix}$$

and a conditional covariance of $$\sum_{11} - \sum_{12} \sum_{22}^{-1} \sum_{21},$$

that is:

$$(Z^C, Z^D \mid Z^A = v, Z^B = w) \sim N\left(\sum_{12} \sum_{22}^{-1} \begin{pmatrix} v \\ w \end{pmatrix}, \sum_{11} - \sum_{12} \sum_{22}^{-1} \sum_{21}\right) \tag{11}$$

Hereinbelow, the term $$\sum_{12} \sum_{22}^{-1}$$

is referred to as the conditional correction matrix, which is used to calculate the correction, given a miss vector (v, w). The mean of the conditional distribution of the FFE "miss vector" equals the conditional correction matrix multiplied (by matrix multiplication) by the registration miss vector $$\begin{pmatrix} v \\ w \end{pmatrix}.$$

That is, in order to minimize the expected value of the miss from the intended FFE target, the target coordinates entered to the BSE should be corrected by subtracting the correction vector from $$\sum_{12} \sum_{22}^{-1} \begin{pmatrix} v \\ w \end{pmatrix}$$

from the intended FFE target coordinates.

The residual error, by applying the correction vector, will be $$\sum_{11} - \sum_{12} \sum_{22}^{-1} \sum_{21}.$$

ECVC Enhancement Over Basic CVC

The assumptions of the basic CVC, that the same charge, trajectory (high/low) and gun will be used, are assumptions that limit firing accuracy when these firing conditions cannot be kept the same for both registration and FFE. The error-correlated CVC (hereinbelow "ECVC") method has been developed to improve accuracy of target correction when the firing conditions are not constant. The main enhancement of ECVC over the basic CVC is that systemic errors of firing conditions, for registration and for FFE, are not assumed to be perfectly correlated. Rather the correlation may be different and may also change with the passage of time, i.e.:

$$(X_{0,1}, X_{0,2}, \ldots, X_{0,n}, X_{1,1}, X_{1,2}, \ldots, X_{1,n}) \sim N(0, W(t)) \tag{12}$$

where $X_{0,j}$ are the registration errors, $X_{1,j}$ are the FFE errors, and W(t) is a general 2n×2n time dependent error covariance matrix. The function W (t) can also be written $W_{ki,lj}(t)=E(X_{k,i}X_{l,j})$ (t), where k and l=0 (for the registration target) and =1 (for the FFE target), and i and j=0, 1, . . . , n (error factors). W(t) essentially encompasses all the known data regarding the firing errors: their variances, correlations (between errors of the same type of firing condition for registration and FFE), and the correlations between errors of different firing conditions when changing charges, trajectory, guns, and passage of time.

Explicitly, a systematic effects covariance matrix, $\Sigma_{systematic}$ (t), with all unit effects multiplied by corresponding correlation terms of W(t), can be written as:

$$\sum_{systematic}(t) = \begin{pmatrix} \sum_{i,j} a_i a_j W_{0i,0j}(t) & \sum_{i,j} b_i a_j W_{0i,0j}(t) & \sum_{i,j} c_i a_j W_{1i,0j}(t) & \sum_{i,j} d_i a_j W_{1i,0j}(t) \\ \sum_{i,j} a_j b_j W_{0i,0j}(t) & \sum_{i,j} b_i b_j W_{0i,0j}(t) & \sum_{i,j} c_i b_j W_{1i,0j}(t) & \sum_{i,j} d_i b_j W_{1i,0j}(t) \\ \sum_{i,j} a_i c_j W_{0i,1j}(t) & \sum_{i,j} b_i c_j W_{0i,1j}(t) & \sum_{i,j} c_i c_j W_{1i,1j}(t) & \sum_{i,j} d_i c_j W_{1i,1j}(t) \\ \sum_{i,j} a_i d_j W_{0i,1j}(t) & \sum_{i,j} b_i d_j W_{0i,1j}(t) & \sum_{i,j} c_i d_j W_{1i,1j}(t) & \sum_{i,j} d_{i\ j} W_{1i,1j}(t) \end{pmatrix} \tag{13}$$

Adding the random errors (combining (9) and (13)) gives an effects covariance matrix, $\Sigma_{total}$ which has the following sub-blocks:

- $\Sigma_{11}$(t) (an effects covariance matrix of correlations between errors of conditions during registration fire),
- $\Sigma_{12}$(t) (an effects covariance matrix of correlations between errors of conditions during registration fire and errors of conditions during FFE),
- $\Sigma_{21}$(t) (an effects covariance matrix of correlations between errors of conditions during registration fire and errors of conditions during FFE—transposed),
- $\Sigma_{22}$(t) (an effects covariance matrix of correlations between errors of conditions during FFE). The effects covariance matrix may be calculated as follows:

$$\sum_{total} = \sum_{systematic}(t) + \sum_{random} = \begin{pmatrix} \sum_{11}(t) & \sum_{12}(t) \\ \sum_{21}(t) & \sum_{22}(t) \end{pmatrix} \tag{14}$$

$$\sum_{11}(t) = \begin{pmatrix} \sum_{i,j} a_i a_j W_{0i,0j}(t) & \sum_{i,j} b_i a_j W_{0i,0j}(t) \\ \sum_{i,j} a_i b_j W_{0i,0j}(t) & \sum_{i,j} b_i b_j W_{0i,0j}(t) \end{pmatrix}$$

$$\sum_{12}(t) = \begin{pmatrix} \sum_{i,j} c_i a_j W_{1i,0j}(t) & \sum_{i,j} d_i a_j W_{1i,0j}(t) \\ \sum_{i,j} c_i b_j W_{1i,0j}(t) & \sum_{i,j} d_i b_j W_{1i,0j}(t) \end{pmatrix}$$

$$\sum_{21}(t) = \begin{pmatrix} \sum_{i,j} a_i c_j W_{0i,1j}(t) & \sum_{i,j} b_i c_j W_{0i,1j}(t) \\ \sum_{i,j} a_i d_j W_{0i,1j}(t) & \sum_{i,j} b_i d_j W_{0i,1j}(t) \end{pmatrix}$$

$$\sum_{22}(t) = \begin{pmatrix} \sum_{i,j} c_i c_j W_{1i,1j}(t) & \sum_{i,j} d_i c_j W_{1i,1j}(t) \\ \sum_{i,j} c_i d_j W_{1i,1j}(t) & \sum_{i,j} d_i d_j W_{1i,1j}(t) \end{pmatrix}$$

As for the basic CVC calculation described above, the conditional distribution of the miss vector at the FFE target is given by the normal distribution:

$$\left(Z^C(t), Z^D(t) \mid Z^A = v, Z^B = w\right) \cong N\left(\sum_{12}(t)\sum_{22}^{-1}(t)\begin{pmatrix} v \\ w \end{pmatrix}, \sum_{11}(t) - \sum_{12}(t)\sum_{22}^{-1}(t)\sum_{21}(t)\right) \tag{15}$$

The term $$\sum_{12}\sum_{22}^{-1}$$

is referred to herein as the "conditional correction matrix". In order to minimize the expected value of the miss at the intended FFE target, the FFE target coordinates entered into the BSE should be adjusted by subtracting, from the intended FFE target coordinates, a correction vector $\vec{r}_{CVC}$, which equals the conditional correction matrix multiplied by the registration miss vector:

$$\vec{r}_{CVC} = \sum_{12}(t)\sum_{22}^{-1}(t)\begin{pmatrix} v \\ w \end{pmatrix} \tag{16}$$

Given the registration miss vector, the optimal coordinates to target are the adjusted FFE target coordinates, as the adjusted FFE target coordinates represent the mean of target coordinates that may result in the actual, intended FFE coordinates being hit, as indicated by the distribution of equation (15).

The remaining error matrix for the adjusted FFE target coordinates, that is, the residual error, measured as RMSE (root mean standard error) of firing towards the target coordinates adjusted by $\vec{r}_{CVC}$ is $$U_{CVC} = \sum_{11}(t) - \sum_{12}(t)\sum_{22}^{-1}(t)\sum_{21}(t) \tag{17}$$

A single-valued measure for the remaining correction error is:

$$RMSE_{CVC} = \sqrt{\mathrm{Trace}(U_{CVC})/2} = \sqrt{\sum_{i=1}^{2} U_{CVC_{ii}}/2} \tag{18}$$

In short, in order to hit the original FFE target, the fire for effect should be performed towards the adjusted FFE target coordinates:

$$\text{adjusted } FFE \text{ target coordinates (East, North)} = \text{intended } FFE \text{ target coordinates (East, North)} - \vec{r}_{CVC} \tag{19}$$

ECVC Benefits

Standard, non-CVC fire correction methods do not consider the statistical nature of the indirect fire, ignoring the distribution of systematic and random errors and having no way to estimate the statistical accuracy of the correction. Consequently, standard methods are limited to restricted transfer limits, where FFE targets must be close to the registration targets and errors increase significantly as charges, trajectories and/or guns between the registration and the FFE.

The basic CVC addresses some of these issues, taking into account the statistical aspects of the indirect fire, to give the most probable correction to the FFE, when systematic errors are constant and fire conditions don't change from the registration to the FFE fire.

ECVC removes the basic CVC limitations, by including error correlations for fire conditions that change from registration to FFE and which can also change as the time between registration and FFE increases. Consequently ECVC allows operational flexibility, permitting operators to select the most effective gun, charge, and trajectory parameters, while also providing accurate estimates of the possible error. Six "use cases" for ECVC are described below. These use cases are as follows a. Use case 1: Firing different charges on registration and FFE.
b. Use case 2: Firing different trajectories (high/low) on registration and FFE.
c. Use case 3: Compensating for declining correlation as time passes (meteorological message staleness).
d. Use case 4: Firing with different guns (applying CVC for registration to the rear).
e. Use case 5: Combining all of the above for effective Multi-Round Simultaneous Impact (MRSI) fire.
f. Use case 6: Registration firing toward FFE target.

To effectively utilize the ECVC method, operators must have estimates for the statistical distributions and error correlations of fire conditions for registration and for FFE targeting. Methods for obtaining these estimates are described further in the section of this Specification included hereinbelow titled, "Firing Conditions and Derivation of Error Factors". The improved accuracy of ECVC vs. the basic CVC is described further in the section this Specification included hereinbelow titled, "Performance Comparison".

ECVC Process Steps

Figure 2:
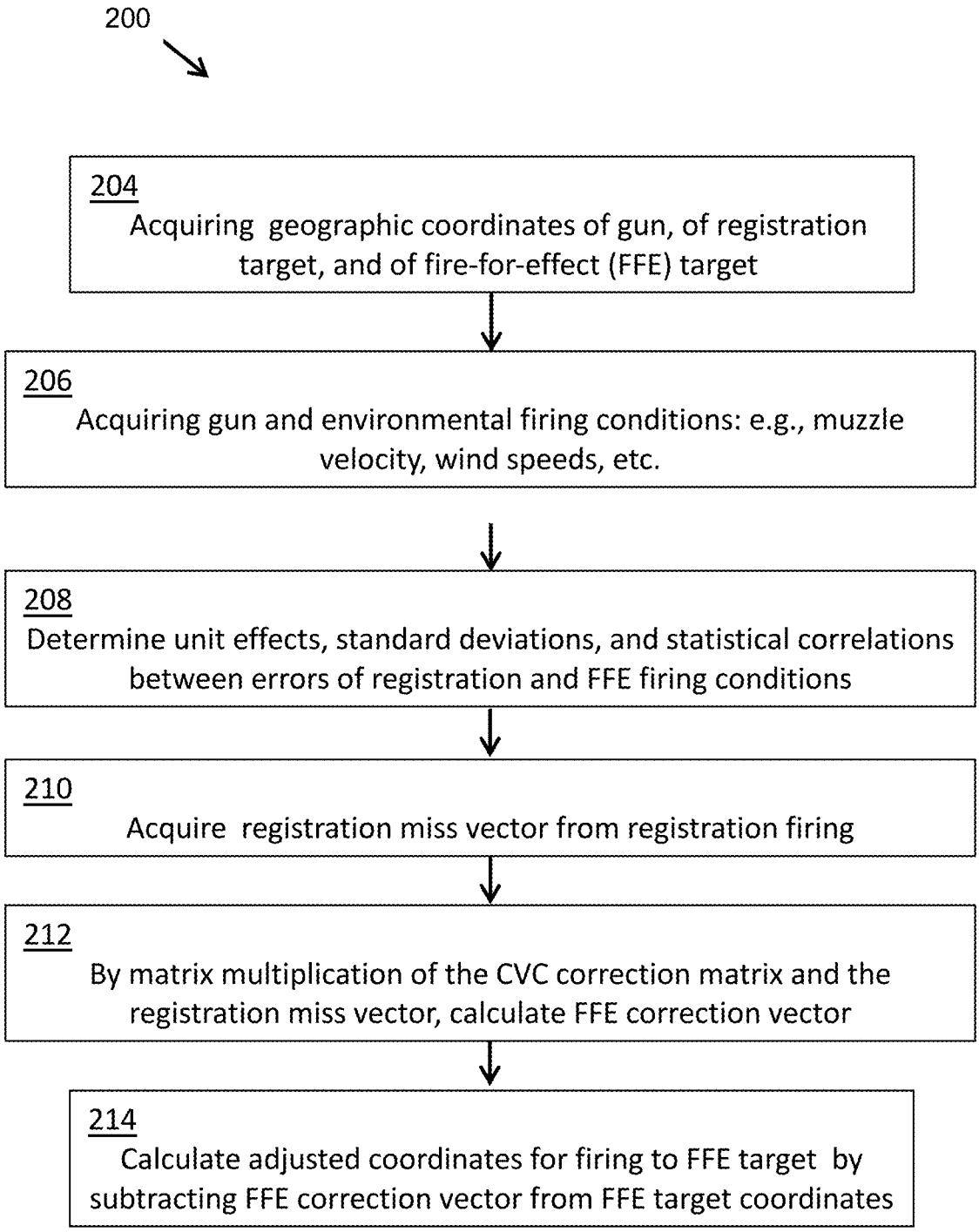
FIG. 2 is a flow diagram of a process for correcting targeting of indirect fire, in accordance with embodiments of the present invention.

FIG. 2 is a flow diagram of an ECVC process 200 for correcting targeting of indirect fire. Hereinbelow, following the description of the process 200, an exemplary ECVC calculation is demonstrated, with exemplary data to indicate how calculations would be performed during actual indirect firing scenarios.

At a first step 204 of the process 200, the ECVC system (i.e., module) acquires geographic coordinates of a gun, of a registration target, and of a fire-for-effect (FFE) target. Typically location coordinates are determined by a combination of GPS and coordinates indicating the targets on maps.

At a step 206, the ECVC system acquires a set of values of firing conditions, including gun and/or environmental conditions, for both registration and FFE firing. FIG. 3 shows an exemplary list of typical firing conditions that can be applied to ECVC calculations. The table also lists factors that are responsible for error correlations between the firing conditions. For example, wind conditions for registration and FFE firing may be fully correlated if the trajectory and gun location do not change, and if the time delay between the firings is short. Otherwise, if any of these conditions do not hold (i.e., the gun or charge change, or the time delay is significant), the wind conditions will not be fully correlated. As a result, the error covariance matrix, $W_{ki,lj}(t)$, from equations 12 and 13 above, will include a correlation term having a value of less than 1 for the correlation between registration and FFE wind conditions. As shown in the table of FIG. 3, other firing conditions that may be included in the error covariance matrix may include: air pressure, air temperature, projectile mass, ballistic drag coefficient, ballistic lift coefficient, charge, barrel wear, ammunition lot, propellant lot, propellant temperature, elevation setting accuracy, elevation jump, azimuth setting accuracy, azimuth jump, gun location, and target location. The list of firing conditions listed in the table is only a partial list of firing conditions that may be incorporated in the ECVC calculations. The more firing conditions included, the more accurate the final FFE correction will be.

It is to be understood that firing conditions (without standard deviation or correlation parameters) are also used by the calculations of the BSE. However, it is to be understood that the firing conditions used by the BSE do not have to be the same firing conditions applied to the ECVC calculations.

Returning to FIG. 2, at a step 208, for each of the firing conditions that are to be used in the calculations, estimates must be input to the ECVC for "unit effects" (also referred to as "ballistic partials"), for standard deviations, and for correlations between registration and FFE firing condition errors.

Multiple test firings can be performed prior to operational use in order to determine standard deviations of systematic and random firing errors of the selected firing conditions. Another option is to analyze historical firing data, if available.

Correlations can also be estimated if sources of the errors are known. For example, muzzle velocity error is primarily due to variability between charges and barrel wear. It can be estimated that both parameters contribute a similar magnitude of error. Therefore, if the charge is changed between registration and FFE, but the same gun is used, only half of the variability is due to the change of the charge, such that an approximate correlation of 0.5 would be appropriate ("approximate" being, for example +/−10%).

Unit effects (equation 3, above) can be estimated by applying slight variations of firing conditions to the BSE (in "forward run") and generating hits according to the variations. For example, to calculate a unit effect for muzzle velocity, the BSE can be run with the expected value of muzzle velocity and then with a value that is higher than nominal by 5 m/s. The difference between the calculated impact points is the total effect of a 5 m/s muzzle velocity change. To calculate the "unit" effect, divide the total by 5.

At a step 210, a registration miss vector is acquired as a result of firing the gun for registration toward a registration target. The parameters for aiming the gun, i.e., elevation and azimuth parameters, would typically be generated by a ballistic simulation engine (BSE), given firing conditions that would typically include gun and environmental conditions. The registration miss vector is the difference between the actual location of impact and the coordinates of the intended registration target.

At a step 212, an FFE correction vector can be calculated according to equation (16) above, by matrix multiplication of the CVC correction matrix and the registration miss vector.

At a step 214, FFE target "adjusted coordinates" can then be calculated by subtracting the FFE correction vector from the intended FFE target coordinates, thereby maximizing the likelihood of hitting the intended FFE target coordinates. The adjusted coordinates may then be entered to the BSE for generating gun "aiming" parameters, i.e., azimuth and elevation, as well as necessary charge ("propellant"). In addition, before firing, the residual error RMSE value (equation 18) can be checked to confirm that the error is less than a user predefined threshold. If the error is greater than the threshold, operators may decide to add one or more registration firings to improve the accuracy before targeting the FFE. The error at varying distances from a given registration target can also be pre-calculated on a contour map to determine the region to which FFE can be performed, given an allowed remaining error threshold. (See the section below titled, "Contour Maps of Residual Errors".)

Sample ECVC Calculations

To demonstrate the ECVC method described above as process 200, the following sample calculations are provided. First, the scenario described above as "use case 1" is presented. For use case 1, only the charge size (charge "lot") is changed between the registration and FFE firing. For the sake of the demonstration, exemplary data is assumed as follows:

1) gun coordinates: 3152000 North, 571000 East
2) registration target coordinates: 3152000 North, 590000 East
3) FFE target coordinates: 3172000 North, 573000 East Typically location coordinates are determined by a combination of GPS and coordinates available from maps, as described above with respect to the step 204 of process 200.

As described above with respect to the step 206, a set of firing conditions whose errors are correlated must be selected for ECVC. For the purpose of a sample calculation, selected firing conditions are the wind conditions—i.e., speed vectors of north wind (WN) and east wind (WE)—and the muzzle velocity (MV). Note that the actual values of these conditions should be provide to the BSE, whereas the ECVC calculations need the error ranges of standard deviation, unit effects, and correlations. Processes for determining these values are also described in more detail in the section below titled, "Firing Conditions and Derivation of Error Factors". The following error values are used for the sample calculations:

1) Systemic and random standard deviations for the registration:
   a) Wind from North (WN): $\sigma_{0,1=5}$, $\tau_{0,1}=2$
   b) Wind from East (WE): $\sigma_{0,2}=5$, $\tau_{0,2}=2$
   c) Muzzle velocity (MV): $\sigma_{0,3}=3$, $\tau_{0,3}=1$ 2) Systemic and random standard deviations for FFE:

a) Wind from North (WN): $\sigma_{1,1}=5$, $\tau_{1,1}=2$ b) Wind from East (WE): $\sigma_{1,2}=5$, $\tau_{1,2}=2$ c) Muzzle velocity (MV): $\sigma_{1,3}=4$, $\tau_{1,3}=1$ Also at the step 208, ballistic partials ("unit effects") for both registration and FFE targets should be calculated, using BSE simulations. For the firing conditions for the example calculation, BSE simulations can be run both for registration and for FFE, applying both a nominal MV value and a value of 5 m/s higher. The difference between the predicted impact points for the two scenarios is 5 times the unit effect for 1 m/s, so the resulting difference is divided by 5 to give the unit effect. Similar calculations can provide unit effects for the wind velocity vectors.

For the sample calculations, unit effects/ballistic partials are set to:

$$\text{North wind: } u_1^A = 0,\ u_1^B = 20,\ u_1^C = 5,\ u_1^D = 25$$

$$\text{East wind: } u_2^A = 30,\ u_2^B = 0,\ u_2^C = 25,\ u_2^D = 5$$

$$\text{Muzzle velocity: } u_3^A = 40,\ u_3^B = 0,\ u_3^C = 5,\ u_3^D = 35$$

There are two types of correlations to consider, correlations between different types of errors, which are set to 0 (the wind components and the muzzle velocity are independent), and the correlations between the same types of errors, for registration and FFE. The scenario of changing the charge assumes no significant time delay and no change in trajectory. Wind vector errors for registration and FFE can therefore be estimated to be fully correlated (i.e., having a value of "1"), while the muzzle velocity errors for registration and FFE are only partially correlated, because, although the gun is the same for registration and FFE, the charge is different. In such a situation, the correlation may be assumed to be approximately 0.5, that is 0.5+/−10%. The error correlation for MV can be more precisely derived by measuring the error over multiple test firings prior to field operation of the relevant guns. For the sample calculations, the wind vectors are taken to be fully correlated, while the muzzle velocity error correlation for the change in the charge is taken as approximately 0.5, as described above.

All random errors are uncorrelated, meaning the respective correlations are 0.

This yields an error covariance matrix for the normalized errors as follows, based on equation (12), firing condition labels shown in the first row and first column:

$$W = \begin{pmatrix} & WN\ reg. & WE\ reg. & MV\ reg. & WN\ FFE & WE\ FFE & MV\ FFE \\ WN\ reg. & 1 & 0 & 0 & 1 & 0 & 0 \\ WE\ reg. & 0 & 1 & 0 & 0 & 1 & 0 \\ MV.\ reg. & 0 & 0 & 1 & 0 & 0 & 0.5 \\ WN\ FFE & 1 & 0 & 0 & 1 & 0 & 0 \\ WE\ FFE & 0 & 1 & 0 & 0 & 1 & 0 \\ MV\ FFE & 0 & 0 & 0.5 & 0 & 0 & 1 \end{pmatrix}$$

Next, calculate the parameters of equation (4) for the covariance matrix:

$$a.\quad a_1 = u_1^A\sigma_{0,1} = 0,\ a_2 = u_2^A\sigma_{0,2} = 150,\ a_3 = u_3^A\sigma_{0,3} = 120$$

$$b.\quad b_1 = u_1^B\sigma_{0,1} = 100,\ b_2 = u_2^B\sigma_{0,2} = 0,\ b_3 = u_3^B\sigma_{0,3} = 0$$

$$c.\quad c_1 = u_1^C\sigma_{1,1} = 25,\ c_2 = u_2^C\sigma_{1,2} = 125,\ c_3 = u_3^C\sigma_{1,3} = 20$$

$$d.\quad d_1 = u_1^D\sigma_{1,1} = 125,\ d_2 = u_2^D\sigma_{1,2} = 25,\ d_3 = u_3^D\sigma_{1,3} = 140$$

Also calculate the parameters of equation (9) of the covariance matrix:

$$e.\quad a'_1 = u_1^A\tau_{0,1} = 0,\ a'_2 = u_2^A\tau_{0,2} = 60,\ a'_3 = u_3^A\tau_{0,3} = 40$$

$$f.\quad b'_1 = u_1^B\tau_{0,1} = 40,\ b'_2 = u_2^B\tau_{0,2} = 0,\ b'_3 = u_3^B\tau_{0,3} = 0$$

$$g.\quad c'_1 = u_1^C\tau_{1,1} = 10,\ c'_2 = u_2^C\tau_{1,2} = 50,\ c'_3 = u_3^C\tau_{1,3} = 5$$

$$h.\quad d'_1 = u_1^D\tau_{1,1} = 50,\ d'_2 = u_2^D\tau_{1,2} = 10,\ d'_3 = u_3^D\tau_{1,3} = 35$$

As indicated in equation (9), the number of rounds fired for registration and for FFE are additional parameters that must also be acquired. Exemplary data for the exemplary calculations below will be as follows: $n_0=4$ (4 rounds for registration fire), $n_1=10$ (10 rounds for FFE).

2) Calculate the improved effects covariance matrix [eq. 13]:

$$\sum_{systematic}(t) ==$$

$$\begin{pmatrix} \sum_{i,j} a_i a_j W_{0i,0j}(t) & \sum_{i,j} b_i a_j W_{0i,0j}(t) & \sum_{i,j} c_i a_j W_{1i,0j}(t) & \sum_{i,j} d_i a_j W_{1i,0j}(t) \\ \sum_{i,j} a_j b_j W_{0i,0j}(t) & \sum_{i,j} b_i b_j W_{0i,0j}(t) & \sum_{i,j} c_i b_j W_{1i,0j}(t) & \sum_{i,j} d_i b_j W_{1i,0j}(t) \\ \sum_{i,j} a_i c_j W_{0i,1j}(t) & \sum_{i,j} b_i c_j W_{0i,1j}(t) & \sum_{i,j} c_i c_j W_{1i,1j}(t) & \sum_{i,j} d_i c_j W_{1i,1j}(t) \\ \sum_{i,j} a_i d_j W_{0i,1j}(t) & \sum_{i,j} b_i d_j W_{0i,1j}(t) & \sum_{i,j} c_i d_j W_{1i,1j}(t) & \sum_{i,j} d_i d_j W_{1i,1j}(t) \end{pmatrix} =$$

$$\begin{pmatrix} 36900 & 0 & 3075 & 12150 \\ 0 & 14400 & 2500 & 12500 \\ 3075 & 2500 & 16650 & 9050 \\ 12150 & 12500 & 9050 & 35850 \end{pmatrix}$$

Example of a single element calculation:

$$\sum_{systematic}(t)_{1,4} = \sum_{i,j} d_i a_j W_{1i,0j}(t) = 125 \cdot 0 \cdot 1 + 150 \cdot 25 \cdot 1 + 140 \cdot 120 \cdot 0.5 = 12150$$

Calculate the random covariance matrix [eq. 9]:

$$\sum_{random} = \begin{pmatrix} \sum_{j=1}^{n} \frac{a_j'^2}{n_0} & \sum_{j=1}^{n} \frac{b_j' a_j'}{n_0} & 0 & 0 \\ \sum_{j=1}^{n} \frac{a_j' b_j'}{n_0} & \sum_{j=1}^{n} \frac{b_j'^2}{n_0} & 0 & 0 \\ 0 & 0 & \sum_{j=1}^{n} \frac{c_j'^2}{n_1} & \sum_{j=1}^{n} \frac{d_j' c_j'}{n_1} \\ 0 & 0 & \sum_{j=1}^{n} \frac{c_j' d_j'}{n_1} & \sum_{j=1}^{n} \frac{d_j'^2}{n_1} \end{pmatrix} ==$$

$$\begin{pmatrix} 1300 & 0 & 0 & 0 \\ 0 & 400 & 0 & 0 \\ 0 & 0 & 262.5 & 117.5 \\ 0 & 0 & 117.5 & 382.5 \end{pmatrix}$$

From equation (14), the total effects covariance matrix is given as:

$$\sum_{total}(t) = \sum_{systematic}(t) + \sum_{random} ==$$

$$\begin{pmatrix} 36900 & 0 & 3075 & 12150 \\ 0 & 14400 & 2500 & 12500 \\ 3075 & 2500 & 16650 & 9050 \\ 12150 & 12500 & 9050 & 35850 \end{pmatrix} + \begin{pmatrix} 1300 & 0 & 0 & 0 \\ 0 & 400 & 0 & 0 \\ 0 & 0 & 262.5 & 117.5 \\ 0 & 0 & 117.5 & 382.5 \end{pmatrix} =$$

$$\begin{pmatrix} 38200 & 0 & 3075 & 12150 \\ 0 & 14800 & 2500 & 12500 \\ 3075 & 2500 & 16912.5 & 9167.5 \\ 12150 & 12500 & 9167.5 & 36233.5 \end{pmatrix} = \begin{pmatrix} \sum_{11}(t) & \sum_{12}(t) \\ \sum_{21}(t) & \sum_{22}(t) \end{pmatrix}$$

The block matrices are:

$$\sum_{11}(t) = \begin{pmatrix} 38200 & 0 \\ 0 & 14800 \end{pmatrix}$$

$$\sum_{12}(t) = \begin{pmatrix} 3075 & 12150 \\ 2500 & 12500 \end{pmatrix}$$

-continued $$\sum_{21}(t) = \begin{pmatrix} 3075 & 2500 \\ 12150 & 12500 \end{pmatrix}$$

$$\sum_{22}(t) = \begin{pmatrix} 16912.5 & 9167.5 \\ 9167.5 & 36233.5 \end{pmatrix}$$

As described above, at the step 210, registration is performed by firing towards a registration target and acquiring a registration miss vector resulting by during the difference between the registration target and the point of impact. For the sample calculation, the following values are assumed:

1) Registration target coordinates: (3152000 North, 590000 East)
2) Actual hit (MPI): (3152300 North, 590200 East)
3) Miss vector=Actual hit−Target=(3152300−3152000, 590200−590000)=(300 m North, 200 m East), that is, $$Z^A = 200 \text{ m}, Z^B = 300 \text{ m}$$

At the step 212, described above, the CVC correction matrix is calculated from $\Sigma_{12}(t)$ and $$\sum_{22}^{-1}(t).$$

For the sample calculation, this gives:

$$\sum_{12}(t)\sum_{22}^{-1}(t) = \begin{pmatrix} 3075 & 12150 \\ 2500 & 12500 \end{pmatrix}\begin{pmatrix} 16912.5 & 9167.5 \\ 9167.5 & 36233.5 \end{pmatrix}^{-1}$$

The FFE correction vector $\vec{r}_{CVC}$ is then calculated by matrix multiplication of the CVC correction matrix and the registration miss vector:

$$\vec{r}_{CVC} = \sum_{12}(t)\sum_{22}^{-1}(t)\begin{pmatrix} v \\ w \end{pmatrix} =$$

$$\begin{pmatrix} 3075 & 12150 \\ 2500 & 12500 \end{pmatrix}\begin{pmatrix} 16912.5 & 9167.5 \\ 9167.5 & 36233.5 \end{pmatrix}^{-1}\begin{pmatrix} 200 \\ 300 \end{pmatrix} = \begin{pmatrix} 101.6 \\ 97.9 \end{pmatrix}$$

Note that the greater the correlation between the errors, the bigger the correction vector. This is because the greater the correlation between the registration and FFE errors, the more the information from the registration shot indicates the likely FFE result.

The adjusted coordinates of the FFE target for firing are then passed to operators (i.e., the mission control) [eq. 19]:

$$\text{adjusted } FFE \text{ target coordinates (East, North)} = \text{intended } FFE \text{ target coordinates (East, North)} - \vec{r}_{CVC} = (3172000, 573000) - (101.6, 97.9) = (3{,}171{,}898.4, 572{,}902.1)$$

For use case 2, changing the trajectory after registration, all correlations between different types of errors are 0 (the wind components and the muzzle velocity are independent), but correlations between each wind component for the two trajectories are 0.75, because the projectile passes different layers of atmosphere in a high trajectory as compared with a lower trajectory. The value of 0.75 was estimated as a ratio between the maximum heights of the low and the high trajectories, but can be done in other ways, for example statistical analysis/simulation of wind behavior in the relevant location.

Correlation between muzzle velocity error for both trajectories is 1 because the same charge is used.

This gives an error covariance matrix W for the normalized errors:

$$W = \begin{pmatrix} & WN\ reg. & WE\ reg. & MV\ reg. & WN\ FFE & WE\ FFE & MV\ FFE \\ WN\ reg. & 1 & 0 & 0 & 0.75 & 0 & 0 \\ WE\ reg. & 0 & 1 & 0 & 0 & 0.75 & 0 \\ MV.\ reg. & 0 & 0 & 1 & 0 & 0 & 1 \\ WN\ FFE & 0.75 & 0 & 0 & 1 & 0 & 0 \\ WE\ FFE & 0 & 0.75 & 0 & 0 & 1 & 0 \\ MV\ FFE & 0 & 0 & 1 & 0 & 0 & 1 \end{pmatrix}$$

The error covariance matrix change is the only change to the process described above, so the remaining steps would be calculated by similar steps to those shown above.

For use case 3, for a time delay between registration and FFE that reduces the wind velocity correlations, these correlations can be obtained by statistical analysis of the meteorological conditions in the relevant location. In general, the longer the delay after registration, the lower the correlation.

This yields error covariance matrices (for FFE 1 and 2 hours after the registration) for the normalized errors:

$$W(1\text{ hour}) = \begin{pmatrix} & WN\ reg. & WE\ reg. & MV\ reg. & WN\ FFE & WE\ FFE & MV\ FFE \\ WN\ reg. & 1 & 0 & 0 & 0.9 & 0 & 0 \\ WE\ reg. & 0 & 1 & 0 & 0 & 0.9 & 0 \\ MV.\ reg. & 0 & 0 & 1 & 0 & 0 & 0.9 \\ WN\ FFE & 0.9 & 0 & 0 & 1 & 0 & 0 \\ WE\ FFE & 0 & 0.9 & 0 & 0 & 1 & 0 \\ MV\ FFE & 0 & 0 & 1 & 0 & 0 & 1 \end{pmatrix}$$

$$W(2\text{ hour}) = \begin{pmatrix} & WN\ reg. & WE\ reg. & MV\ reg. & WN\ FFE & WE\ FFE & MV\ FFE \\ WN\ reg. & 1 & 0 & 0 & 0.7 & 0 & 0 \\ WE\ reg. & 0 & 1 & 0 & 0 & 0.7 & 0 \\ MV.\ reg. & 0 & 0 & 1 & 0 & 0 & 0.7 \\ WN\ FFE & 0.7 & 0 & 0 & 1 & 0 & 0 \\ WE\ FFE & 0 & 0.7 & 0 & 0 & 1 & 0 \\ MV\ FFE & 0 & 0 & 1 & 0 & 0 & 1 \end{pmatrix}$$

For use case 4, changing guns (and therefore gun locations), correlation between the location of the guns is 0 (measured independently). The correlation between target location is still 1 (i.e., the same value for all guns). The correlation between muzzle velocity error between guns is taken to be approximately 0.5 (+/−10%). This can be estimated by statistical analysis of the gun fleet, for example by measuring the distribution of barrel erosion, for the same or different charge production batches, etc. Here it is assumed that the same production batch is used for all guns, but that there is an error in measurement of the barrel erosion. The expectation is that these factors have a roughly similar effect on the muzzle velocity, meaning that the correlation is approximately 0.5 between the muzzle velocities of different guns.

This yields an error covariance matrix for the normalized errors as follows:

$$W = \begin{array}{c} \\ \text{gun } reg. \\ \text{target } reg. \\ MV.\ reg. \\ \text{gun } FFE \\ \text{target } FFE \\ MV\ FFE \end{array} \begin{array}{c} \begin{array}{cccccc} \text{gun } reg. & \text{target } reg. & MV\ reg. & \text{gun } FFE & \text{target } FFE & MV\ FFE \end{array} \\ \begin{pmatrix} 1 & 0 & 0 & 0 & 0 & 0 \\ 0 & 1 & 0 & 0 & 1 & 0 \\ 0 & 0 & 1 & 0 & 0 & 0.5 \\ 0 & 0 & 0 & 1 & 0 & 0 \\ 0 & 1 & 0 & 0 & 1 & 0 \\ 0 & 0 & 0.5 & 0 & 0 & 1 \end{pmatrix} \end{array}$$

For use case 5, combining all the above changes of use cases 1-4, the following correlations may be applied:

- a correlation between the gun locations is set to 0.
- a correlation between target locations is set to 1, i.e., the same value for all guns.
- a correlation between muzzle velocity error, between guns and between charges is set to 0.25 (same charge manufacturing batch, but different number of charge modules used to fire the projectile, estimated by testing).

Correlations between each wind component for the two trajectories are 0.75, because the projectile is passing through different layers of atmosphere in high trajectory compared to lower trajectory. The estimate can be made, for example, by analysis of meteorological databases. More typically, there will be only a small correlation between wind error components, such as 0.1, as the components are usually calculated from magnitude/direction of the wind, and therefore not totally independent, even if not highly correlated.

This yields an error covariance matrix for the normalized errors as follows:

$$W = \begin{array}{c} \\ \text{gun } reg. \\ \text{target } reg. \\ MV.\ reg. \\ WN\ reg. \\ WE\ reg. \\ \text{gun } FFE \\ \text{target } FFE \\ MV.\ FFE \\ WN\ FFE \\ WE\ FFE \end{array} \begin{array}{c} \begin{array}{cccccccccc} \text{gun } r. & \text{target } r. & MV\ r. & WN\ r. & WE\ r. & \text{gun } FFE & \text{target } FFE & MV.FFE & WN\ FFE & WE\ FFE \end{array} \\ \begin{pmatrix} 1 & 0.1 & 0 & 0 & 0 & 0.75 & 0.1 & 0 & 0 & 0 \\ 0.1 & 1 & 0 & 0 & 0 & 0.1 & 0.75 & 0 & 0 & 0 \\ 0 & 0 & 1 & 0 & 0 & 0 & 0 & 0 & 0 & 0 \\ 0 & 0 & 0 & 1 & 0 & 0 & 0 & 0 & 1 & 0 \\ 0 & 0 & 0 & 0 & 1 & 0 & 0 & 0 & 0 & 0.25 \\ 0.75 & 0.1 & 0 & 0 & 0 & 1 & 0 & 0 & 0 & 0 \\ 0.1 & 0.75 & 0 & 0 & 0 & 0 & 1 & 0 & 0 & 0 \\ 0 & 0 & 0 & 0 & 0 & 0 & 0 & 1 & 0 & 0 \\ 0 & 0 & 0 & 1 & 0 & 0 & 0 & 0 & 1 & 0 \\ 0 & 0 & 0 & 0 & 0.25 & 0 & 0 & 0 & 0 & 1 \end{pmatrix} \end{array}$$

As noted above, the ability to accurately target with different charges, trajectories and guns facilitates effective Multi-Round Simultaneous Impact (MRSI) fire.

For use case 6, the ECVC can be used recursively for a series of converging shots at the FFE target. Each new impact point and its miss vector is used to calculate the conditional distribution of the next shot. East and north wind correlations will be less than one (but greater than zero) if the time delay is significant.

For use case 7, the optimal selection of gun, charge and trajectory firing conditions are determined. The process includes running multiple BSE simulations to determine different possible sets of firing conditions for hitting the same FFE target. For each set of firing conditions, the ECVC is then applied (with an error covariance matrix calculated as above) to determine the appropriate CVC correction vector for the given set, as well as the RMSE. A table with a list of results for each set of firing conditions for the above scenario is shown in FIG. 4. The list is ordered according to RMSE as shown in FIG. 5, which shows that the optimal set, having an RMSE of only 35 m, is the set of firing conditions with gun #2, charge #2, and a low trajectory.

Firing Conditions and Derivation of Error Factors

Relevant firing conditions and their error factors can significantly differ between various indirect firing systems. The table of FIG. 3 provides a partial list of many of the most relevant firing conditions and details on obtaining their associated error factors. These are as follows:

External/Environmental Errors

Air temperature: The standard deviation depends on the accuracy of the meteorological measurements (such as the weather balloon accuracy). The standard deviation is usually on the order of magnitude of several degrees centigrade.

Air pressure: also depends on the accuracy of the meteorological measurement. The standard deviation is usually on the order of less than 10% of the air pressure value.

Wind (two components N and E): Like air pressure, dependent on meteorological measurement error. The order of magnitude of the standard deviation is typically less than 10 m/s.

Location Errors

Gun location: assumed to be the error of the navigational system or the accuracy of manual location on a map. Can be from ~10 m for modern GPS based systems to ~100 m for manual location. The error can be directly measured or taken as the nominal error of the system, typically provided by the manufacturer in technical specifications.

Target location: depends on the fire registration systems employed, as with gun location, can be from ~10 m for aerial systems to ~100 m for manual triangulation. Can be directly measured or taken as the nominal error of the system, provided by the manufacturer in the technical specifications.

Weapon/Ammunition (Gun) Errors

Muzzle velocity (MV) depends on multiple parameters, such as barrel erosion, quality of the charge (also referred to herein as "propellant" or "propellant lot"), and operational procedures (such as whether the same charge and same gun are used for registration and FFE). Thus, MV can vary significantly from few m/s to more than 10 m/s.

Azimuth and elevation accuracy and jump have standard deviations that depend on the specific weapon system and can be expected to be on the order of magnitude of a single milliradian.

Drag, lift and mass: standard deviations depend on the manufacturing quality and consistency of the ammunition, can be on the order of magnitude of a few percent.

Correlations between error conditions need to be estimated specifically for each case. These correlations can be calculated explicitly, given error budgets, or roughly estimated from general principles, sometimes providing good enough results. Here are some examples that can give some guidance for the procedure.

For change of trajectories, without changing the charge, the only difference would be the atmospheric conditions, since a projectile would travel through higher layers of atmosphere for the higher trajectory. The correlation between temperature, pressure and wind can be roughly estimated to be the ratio between maximal height of both trajectories (assuming linear accumulation of errors with height).

A more precise method would be to use a weighted atmosphere calculation, for example as defined in NATO's STANAG 4061 standard (STANAG 4061 MET, EDITION 4—*Adoption Of A Standard Ballistic Meteorological Message*, Military Agency For Standardization, 1110 Brussels, Mar. 10, 2000). Other methods of weighting/weights can be used in a similar manner. For the sake of example, Table G-1 from STANAG 4061 can be used for wind weighting factors for surface-to-surface fire. Table G-2 has weighting factors that can be used for temperature and air density.

Another exemplary scenario is one in which registration fire has a maximum trajectory height of 3500 m, while FFE fire has a maximum trajectory height of 5700 m. From tables G-1, 2, 3 of STANAG 4061, the registration shot rises up to zone 7 (3000 to 4000 m) and the FFE shot to zone 9 (5000 to 7000).

For wind correlation, note that row 9 in table G-1 (corresponding to zone 9) shows that the common weight (up to zone 7) sums to 0.44. This value can be used for the correlation of wind factors.

For air temperature correlation: row 9 in table G-2 (corresponding to zone 9) shows that the common weight (up to zone 7) sums to 0.32 and this value would therefore be appropriate for the correlation of air temperature.

For air pressure, row 9 in table G-3 (corresponding to zone 9) shows that the common weight (up to zone 7) sums to 0.68 and this value would therefore be appropriate for the correlation of air pressure.

These are conservative estimates that assume that there is no correlation between errors in lower and upper layers of the atmosphere. Actual measurement of the errors could yield more realistic values, depending on the actual meteorological equipment/prediction/interpolation methods used.

For change of charges, with the same, the muzzle velocity depends on multiple parameters, all of which can be assumed equal, except for the propellant itself. A rough estimate would be to take a correlation of 0.5, "blaming" half of the variation of the velocity on the propellant manufacturing tolerances. More precise estimate would require a deeper knowledge of the specific errors and variability, and operational specifics.

For change of guns, keeping all the rest the same, this is the opposite of the previous example, so the correlation in the muzzle velocity would also be 0.5 (the other half being due to barrel erosion, propellant temperature, etc.). Also, the gun "self-location" error would be different, and thus its correlation would be 0.

For correlation change over time, generally, the longer the delay between registration and FFE, the lower the correlation of registration and FFE, as uncertainty increases with the passage of time. This is particularly the case for meteorological (environmental) data. This includes: air temperature, density, wind components, muzzle velocity due to charge temperature changes because of ambient conditions, etc. To calculate a specific correlation value, statistical analysis of meteorology in the relevant regions needs to be performed, to assess stability of the atmosphere and the correlation of its values as a function of time.

Gun-related firing conditions usually change less over time and therefore error correlation values do not change rapidly. This typically is the case for muzzle velocity, elevation and azimuth errors, and drag and ballistic coefficients (as well as for gun and target location coordinates).

As mentioned above, the table of FIG. 3 summarizes these steps of determining error parameters that can be incorporated into the ECVC algorithm.

Standard Deviation Empirical Estimations

For all error factors in Table 3, and for all corresponding combinations of granularities for each factor, perform the following steps:

1. Acquire multiple meteorology measurements over multiple dates for all meteorology error types and compare each to a precise measurement.
2. Acquire measurements of average mass of projectiles between multiple production lots and compare to a nominal mass.
3. Acquire elevation and azimuth accuracies on multiple guns and on multiple occasions and compare to values that were supposed to be set.
4. Acquire barrel wear with appropriate gauges on multiple guns and compare to the nominal value.
5. Acquire self-location (i.e., gun location) with the chosen navigation system and compare it to actual location (on both coordinates), for multiple gun locations and occasions.
6. Measure target location with the chosen spotting system and compare to actual location (on both coordinates), for multiple target locations and occasions.
7. Perform live firing tests or direct measurement for all the rest of the errors parameters and comparing to the nominal values.

Each measurement above should be repeated several times on the same occasion to estimate the random error of each factor. Then, for each occasion, calculate the mean value of the repeated measurements, $e_j$ [mv], and the standard deviation of these values, $$e_j^{ST.D.}$$

Calculate the systematic error as a standard deviation $\sigma$ of the error values for each error parameter:

$$\sigma = \sqrt{\frac{1}{n-1}\sum_{j=1}^{n}(e_j - \bar{e})},$$

where $e_j$ is the measurement j of error e, $\bar{e}$ is the average value of all measured errors.

Calculate the random error as a weighted average of standard deviations for each occasion:

$$\tau = \sqrt{\frac{\sum_{j=1}^{n} m_j e_j^{ST.D.}}{\sum_{j=1}^{n} m_j}},$$

where $m_j$ is the number of repeated measurements for each occasion.

A representative example of a muzzle velocity error calculation follows. All other error parameter standard deviations are calculated similarly, just with different numerical values and units.

For charge 1, projectile A, live fire was performed, with different combinations of guns and propellant manufacturing lots. Average muzzle velocity was recorded for each combination. After reducing the nominal muzzle velocity of 600 m/s from each measured value, the following errors were obtained:

| Mean error in mv [m/s] $e_j$ | Standard Deviation in mv [m/s] $e_j^{ST.D.}$ | Number of repeated measurements $m_j$ |
|---|---|---|
| −19 | 2.5 | 5 |
| 13 | 1.1 | 6 |
| 29 | 2.4 | 5 |
| 7 | 1.7 | 7 |
| −59 | 2.5 | 10 |
| −25 | 1.0 | 10 |
| −11 | 0.5 | 6 |
| 41 | 2.9 | 7 |
| 12 | 3.1 | 2 |
| −7 | 2.0 | 5 |

These values yield $$\sigma = \sqrt{\frac{1}{n-1}\sum_{j=1}^{n}(e_j - \bar{e})} = 29.9 \text{ m/s},$$

$$\tau = \sqrt{\frac{\sum_{j=1}^{n} m_j e_j^{ST.D.}}{\sum_{j=1}^{n} m_j}} = 1.9 \text{ m/s}.$$

Correlation Empirical Estimates

It is impractical to give an example of calculation of correlations between all the dozens of possible combinations of errors. It is however possible to point to a few specific scenarios and rules that can be applied for each such a pair.

First, the correlation between the same error parameter (diagonal elements of correlation matrix W) are always equal to 1.

Correlation between errors that are a priori identical between registration and FFE firing are also equal to 1. For example, if no charge/gun are changed, we can assume that the systematic error in muzzle velocity is unchanged as well.

Correlation between errors that are a priori unrelated are equal to 0. For example, wind speed error in registration is obviously unrelated to self-location error in FFE firing Correlation between errors that change significantly between registration and FFE can also be assumed to be 0. For example, when changing guns, barrel wear error can be assumed unrelated between them.

When the correlation can not be estimated a priori, an empirical measurement needs to be made. The general principle should be to measure the pair of errors on different occasions and with different values of granularity, as described in Table 3. For example, the correlation between the propellant temperature at the registration time and the propellant temperature at the FFE after 3 hours can be determined by measuring both of these values at the respective time difference and on several occasions. Another example would be the correlation between air pressure between low trajectory at registration and high trajectory for FFE. For this, the maximum heights of both trajectories (using ballistic simulation) should be determined and the effective air pressure for both heights should be measured, at multiple occasions and locations. The same calculations can be performed for air temperature and wind components.

After the pairs of errors are obtained, the correlation can be calculated as described in the following example. The calculations are similar to all possible pairs of errors, just with different typical values and units. For a first scenario, it is assumed that the charge will change (from "1" to "2"), but the gun will be the same. First, perform a live firing experiment (or collect historical data if available) while measuring and recording muzzle velocities, corrected for ambient temperature, for charges 1 and 2. Next, calculate the respective errors of each measurement from the nominal muzzle velocity for each charge.

Next, estimate the covariance matrix for the measurements, using any standard statistical method. A simple, but not exclusive method of calculation would be to apply the equation:

$$\text{Cov} = \frac{1}{n-1}\sum_{j=1}^{n}(S_i - \bar{S})(S_i - \bar{S})^T$$

Where $$S_i = \left(v_i^{charge1} - v_{nominal}^{charge1}, v_i^{charge2} - v_{nominal}^{charge2}\right)$$

is the vector of errors for measurement i out of n, $$\bar{S} = \frac{1}{n}\sum_{j=1}^{n} S_i$$

is the average of all $S_i$. Then $\text{Cov}_{1,2}$ would be the covariance between the muzzle velocities errors when changing between charges 1 and 2, $\text{Cov}_{1,1}$ and $\text{Cov}_{2,2}$ would be the variance of the muzzle velocities errors of charges 1 and 2 correspondingly. Correlation then would just be: $\text{Corr} = \text{Cov}_{1,2}/\sqrt{\text{Cov}_{1,1}\text{Cov}_{2,2}}$ For example, the nominal values for charge 1 is 500 m/s, for charge 2 is 600 m/s. The following pairs of values, with corresponding errors, were measured for muzzle velocities (each pair is fired from same gun with charge 1 and 2 at the same occasion, but different pairs could be fired from different guns and on different occasions):

| v1 | v2 | error 1 | error 2 |
|---|---|---|---|
| 481 | 599 | −19 | −1 |
| 513 | 606 | 13 | 6 |
| 529 | 602 | 29 | 2 |
| 507 | 620 | 7 | 20 |
| 441 | 518 | −59 | −82 |
| 475 | 563 | −25 | −37 |
| 489 | 589 | −11 | −11 |
| 541 | 648 | 41 | 48 |
| 512 | 603 | 12 | 3 |
| 493 | 592 | −7 | −8 |

Using standard calculation of covariance yields: $Cov_{1,2}=903$ for muzzle velocity. Dividing by standard deviations of the errors give a value of 0.91 for the correlation.

Performance Comparison

Comparison between the basic CVC and ECVC can be demonstrated by simulating multiple registration shots and FFE shots and determining which method gives a higher likelihood of FFE impact that is closer to the intended FFE target. The following steps are involved in such a simulation.

First, a scenario is chosen with realistic firing conditions, as follows:

1. Gun location: (0 East, 0 North)
2. Registration target: (0 East, 15,000 m North)
3. Registration firing conditions: low charge, low trajectory
4. FFE target: (10,000 m East, 16,000 m North)
5. FFE firing conditions: high charge, high trajectory
6. Correlations (estimated as described in the section above titled, "Firing Conditions and Derivation of Error Factors"):
   a) muzzle velocity: 0.5,
   b) north wind: 0.75,
   c) east wind: 0.75,
   d) air temperature: 0.9,
   e) air density: 0.9.
   f) All other correlations are 1 between same errors and 0 between different errors.
7. Standard deviations:
   a) muzzle velocity: {systematic: 4.3, random: 1.7},
   b) gun quadrant elevation: {systematic: 0.5, random: 0.5},
   c) gun azimuth: {systematic: 1.0, random: 1.0},
   d) projectile drag: {systematic: 1.0, random: 0.6},
   e) self location north: {systematic: 15.0, random: 0.0},
   f) self location east: {systematic: 15.0, random: 0.0},
   g) target location north: {systematic: 11.0, random: 0.0},
   h) target location east: {systematic: 11.0, random: 0.0},
   i) target height: {systematic: 10.0, random: 0.0},
   j) air density: {systematic: 0.3, random: 0.0},
   k) air temperature: {systematic: 0.35, random: 0.0},
   l) north wind: {systematic: 2.8, random: 0.0},
   m) east wind: {systematic: 2.8, random: 0.0},
8. The specific errors values are not important for the sake of this example, if they are reasonably realistic, so the comparison would be valid to real life applications. These numbers were chosen based on past experience but can be calculated for a specific application using the methods described in the section above titled, "Firing Conditions and Derivation of Error Factors".

The firing conditions and errors were used to sample 1000 random error manifestation cases, using sampling from multivariate normal distribution with expected value of 0 and a conditional covariance matrix with values given above. A ballistic simulation engine (MPMT) was used to simulate actual fire correction performance, for each error manifestation case, with the following steps:

1. Sample the errors (as described above)
2. Calculate ballistic solution to the registration target without using sampled errors (standard conditions).
3. Simulate ballistic trajectory to registration target with standard initial conditions, incorporate the sampled error in the simulation. Find actual hit location and the miss vector at the registration target.
4. Calculate ballistic solution to the FFE target without using sampled errors (standard conditions).
5. For basic CVC:
   a) Apply the basic CVC correction algorithm, given the miss at registration target and find the corrected FFE target coordinates.
   b) Simulate ballistic trajectory to corrected target with standard initial conditions, incorporate the sampled error to the simulation. Find actual hit location and the miss vector at the FFE target.
6. For ECVC:
   c) Apply the ECVC correction algorithm, given the miss at registration target and find the corrected FFE target coordinates.
   d) Simulate ballistic trajectory to corrected target with standard initial conditions, incorporate the sampled error to the simulation. Find actual hit location and the miss vector at the FFE target.
7. Repeat steps 1-6 required number of times to get enough data for statistical analysis and methods comparison (1000 in this case).

The results of the simulation were compared pairwise for each error manifestation in each Monte Carlo run to give vectors of differences between distances of the basic CVC hits and of ECVC hits to the FFE target.

Figure 6:
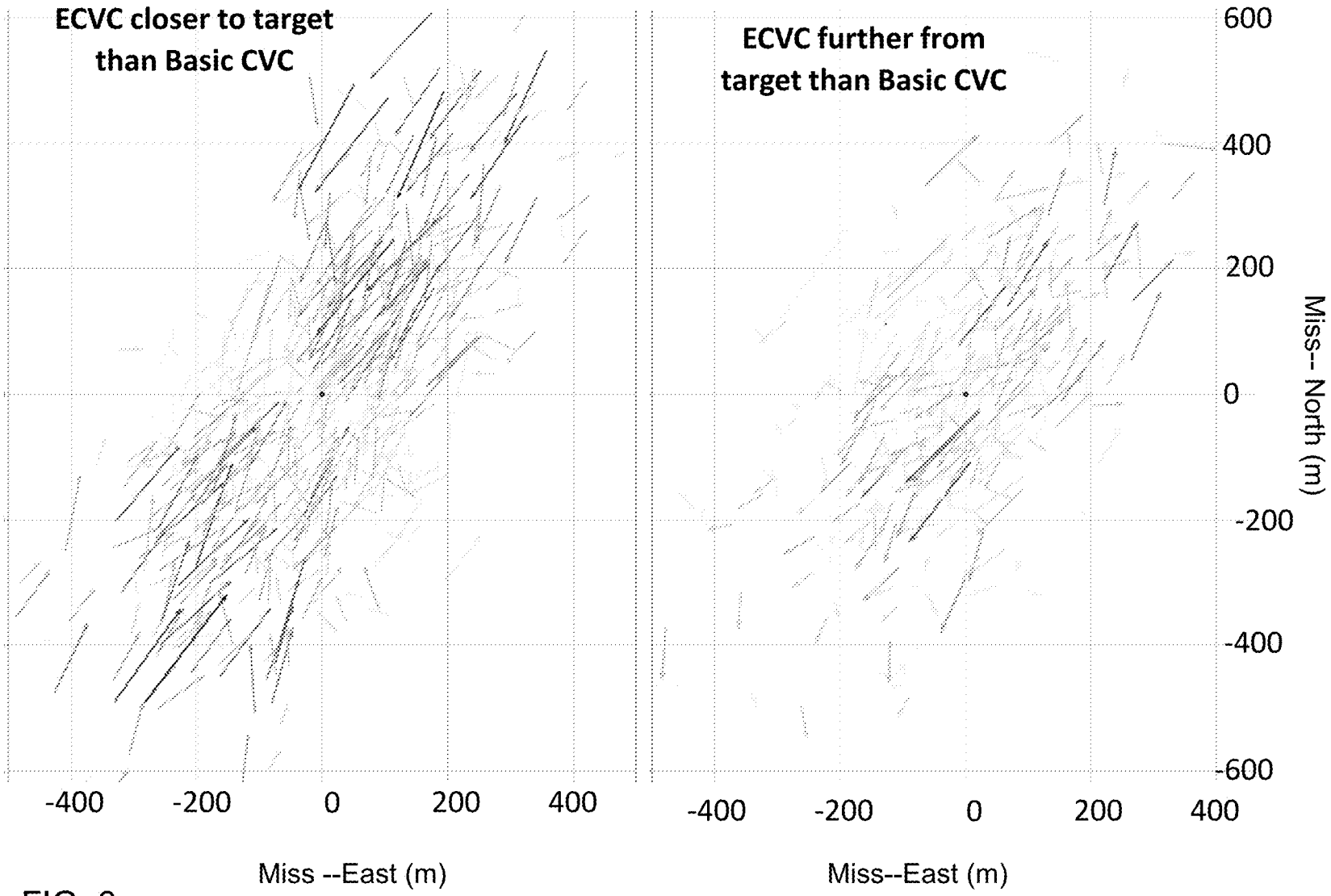
FIGS. 6-7 are graphs demonstrating results of a Monte Carlo simulation of CVC vs. ECVC, in accordance with an embodiment of the present invention.

FIG. 6 shows the distribution of the differences of the distances to the target, based on 1000 Monte Carlo errors manifestation runs applied to the basic CVC and ECVC correction algorithms.

A positive difference means that the ECVC gave a better correction, meaning a closer hit to the target, than the basic CVC. Correspondingly, a negative difference means that that the ECVC gave worse correction than the basic CVC. It can be seen from the distribution that the ECVC was about twice as likely to provide a better correction than the basic CVC.

Figure 7:
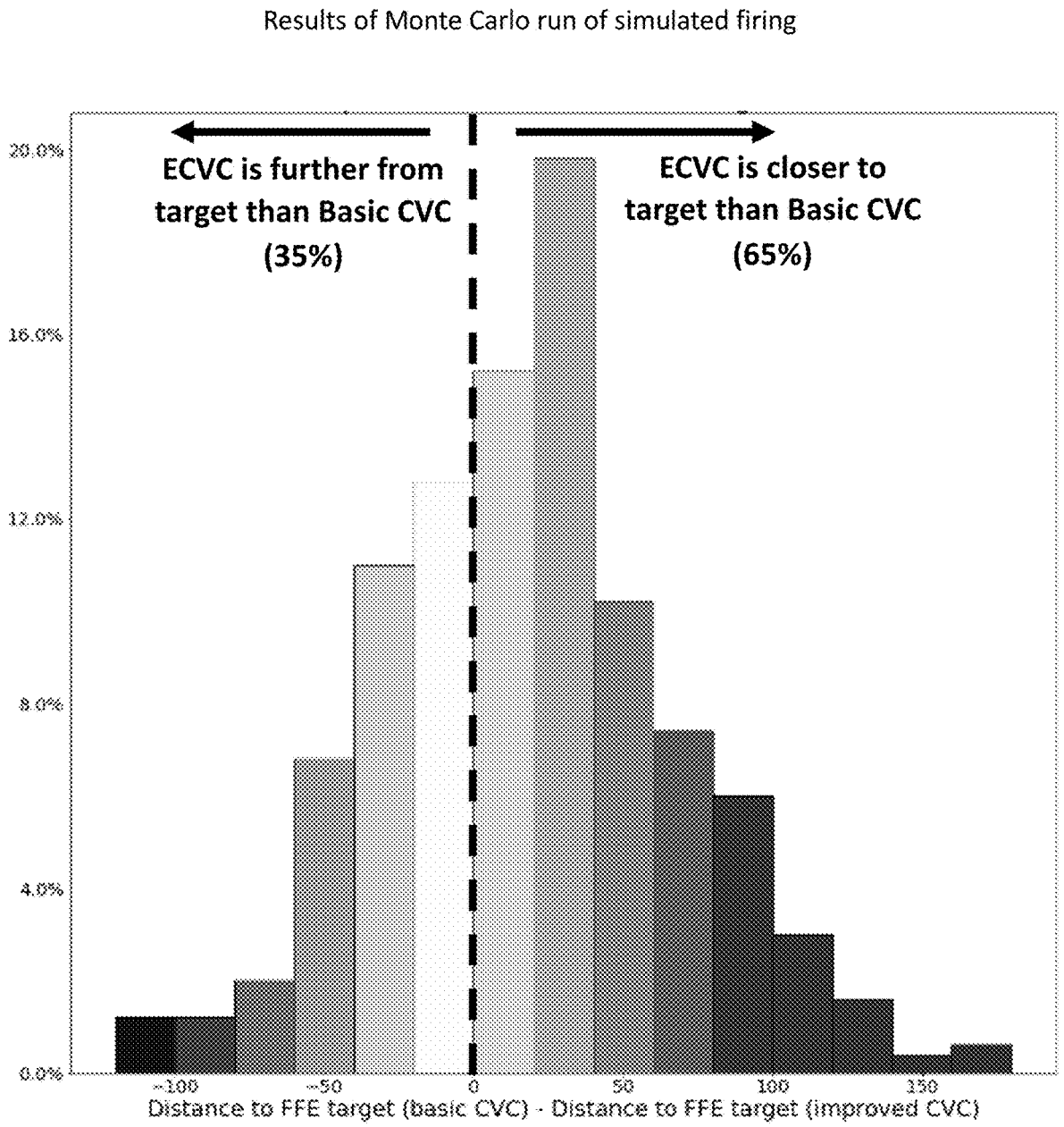

FIG. 7 shows a sampling of the actual hits and differences of the simulated runs. Each arrow denotes one MC run and errors manifestation, while the base denotes the hit with the basic CVC correction and the head the hit with the ECVC correction. The bigger the difference between the method, the less transparent the arrow, while red colors show when the ECVC is better, and blue shows basic CVC being better. For bigger misses (arrows that are further away from the FFE target), caused by extreme error values, the arrows are mostly red and large, meaning that the ECVC was more effective than the basic CVC in those situations. Near the FFE target, the picture is more random, without either method showing a clear advantage. However, these points correspond to small errors manifestations, meaning that correction is less important. The real value of the fire correction is when the miss would be significant.

Contour Maps of Residual Errors

FIGS. 8-12 are contour maps of residual errors of targeting the FFE with adjusted target coordinates calculated by ECVC, based on a registration miss. Each point in each map represents a single FFE target (or a gun in FIG. 12) and the contours encode the remaining error, after the CVC algorithm is used for the specific registration target (same for all the FFE targets). The assumption is that the FFE is performed with optimal correction which reduces the mean value of the miss vector at FFE to zero.

Each map of FIGS. 8-12 was created as follows:

1. Choose a grid of points in the relevant coordinates (limited by maximum range of the ammunition). In this case the grid is 1×1 km squares.
2. At each node of the grid, the ECVC calculation was performed (according to the firing conditions of the use case shown).
3. The residual RMSE values (eq. 18) were added to the graph at the corresponding node 4. Contours with constant RMSE were calculated and color coded.

The graphs, each generated for a specific use case, can be used to decide on the dimensions of the transfer limits, that is, the region for which the FFE targets can be located to ensure that the residual error is below a required threshold. Coordinates on the map can be attributed to regions with different residual errors. (The maps also show rectangular shaped boxes, which delineate the regions that are often used for non-CVC determinations of appropriate FFE target distances.)

Figure 8:
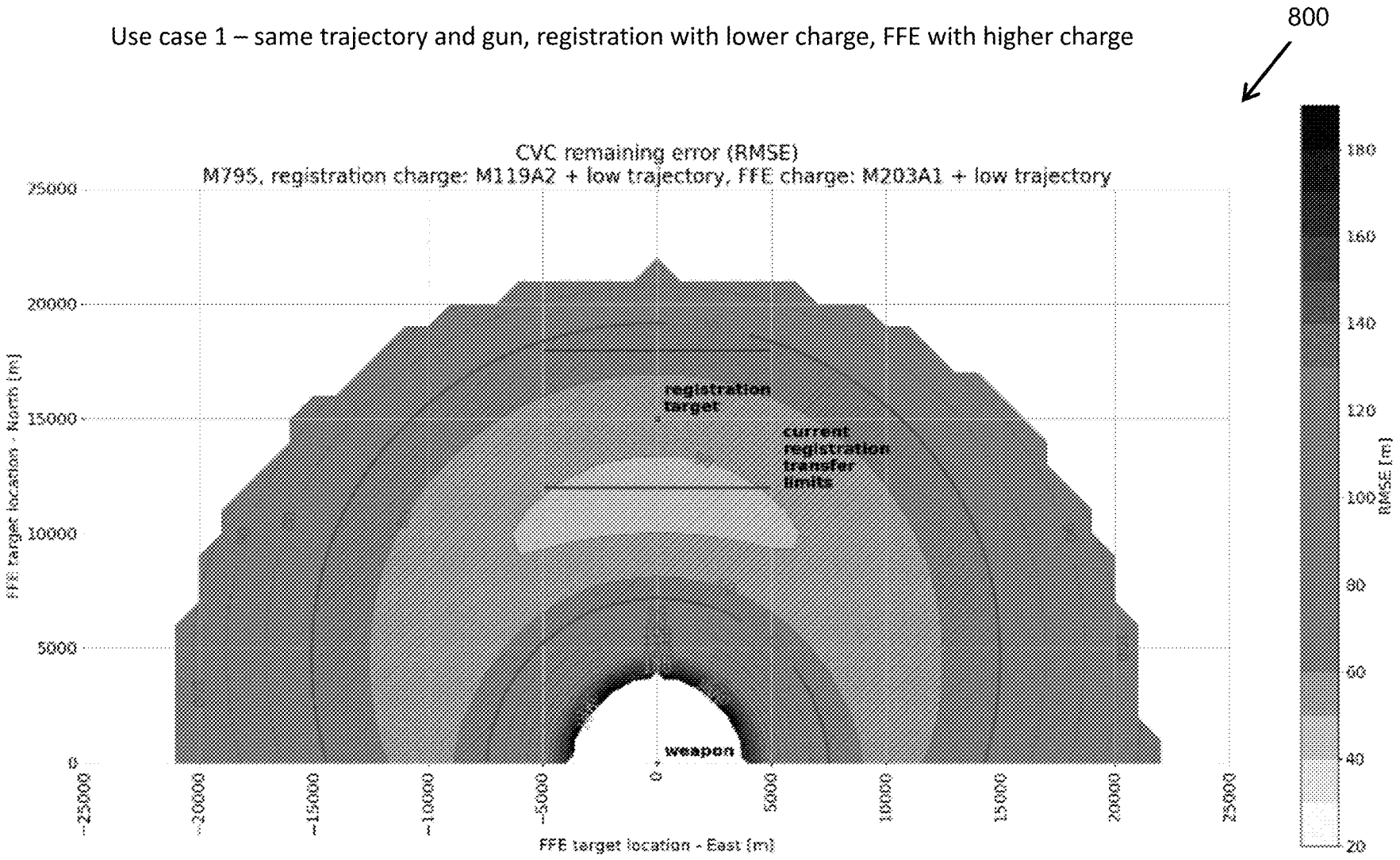
FIGS. 8-12 are contour maps of root mean square errors for target correction in regions of indirect fire, in accordance with embodiments of the present invention.
Figure 9:
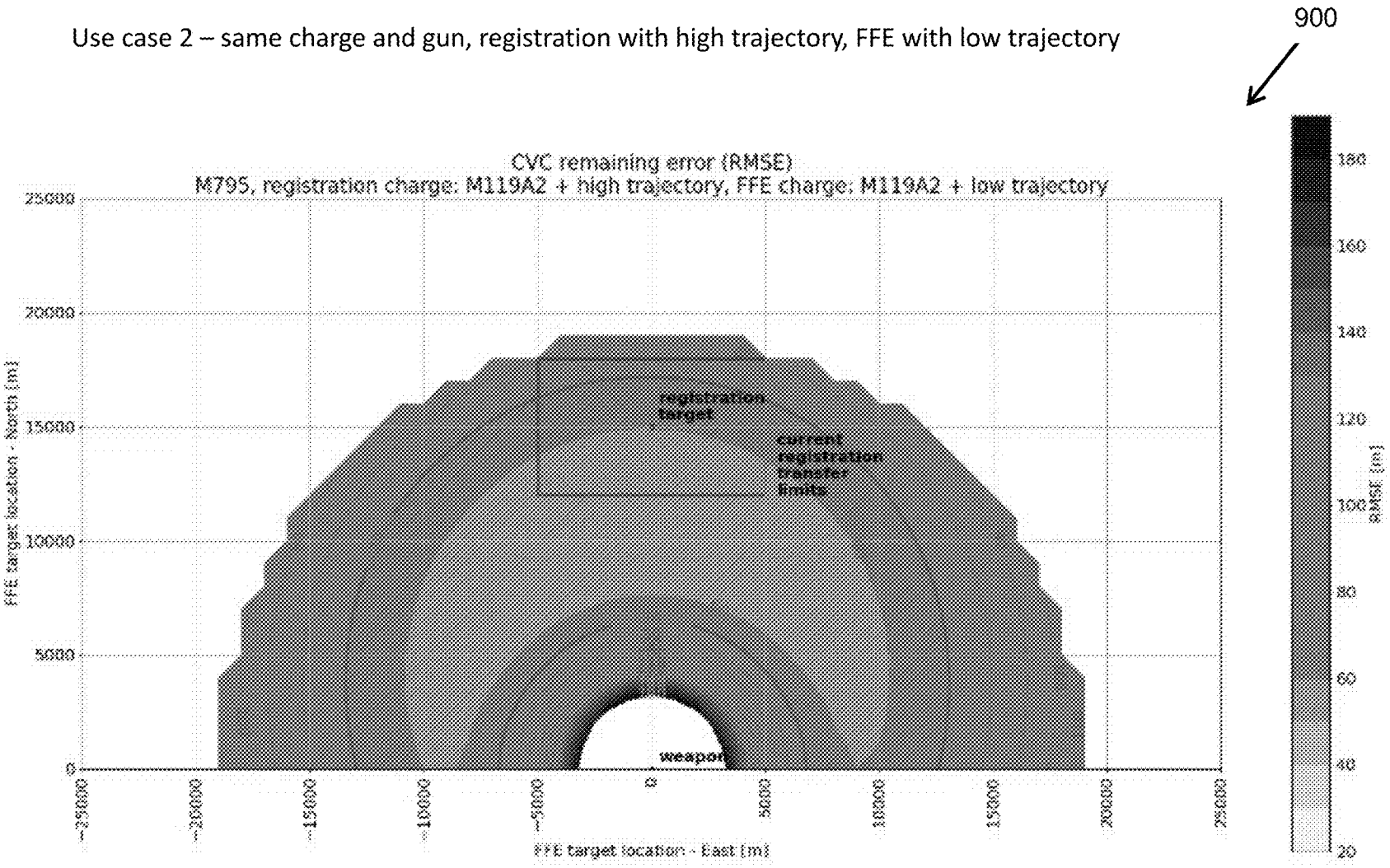
Figure 10:
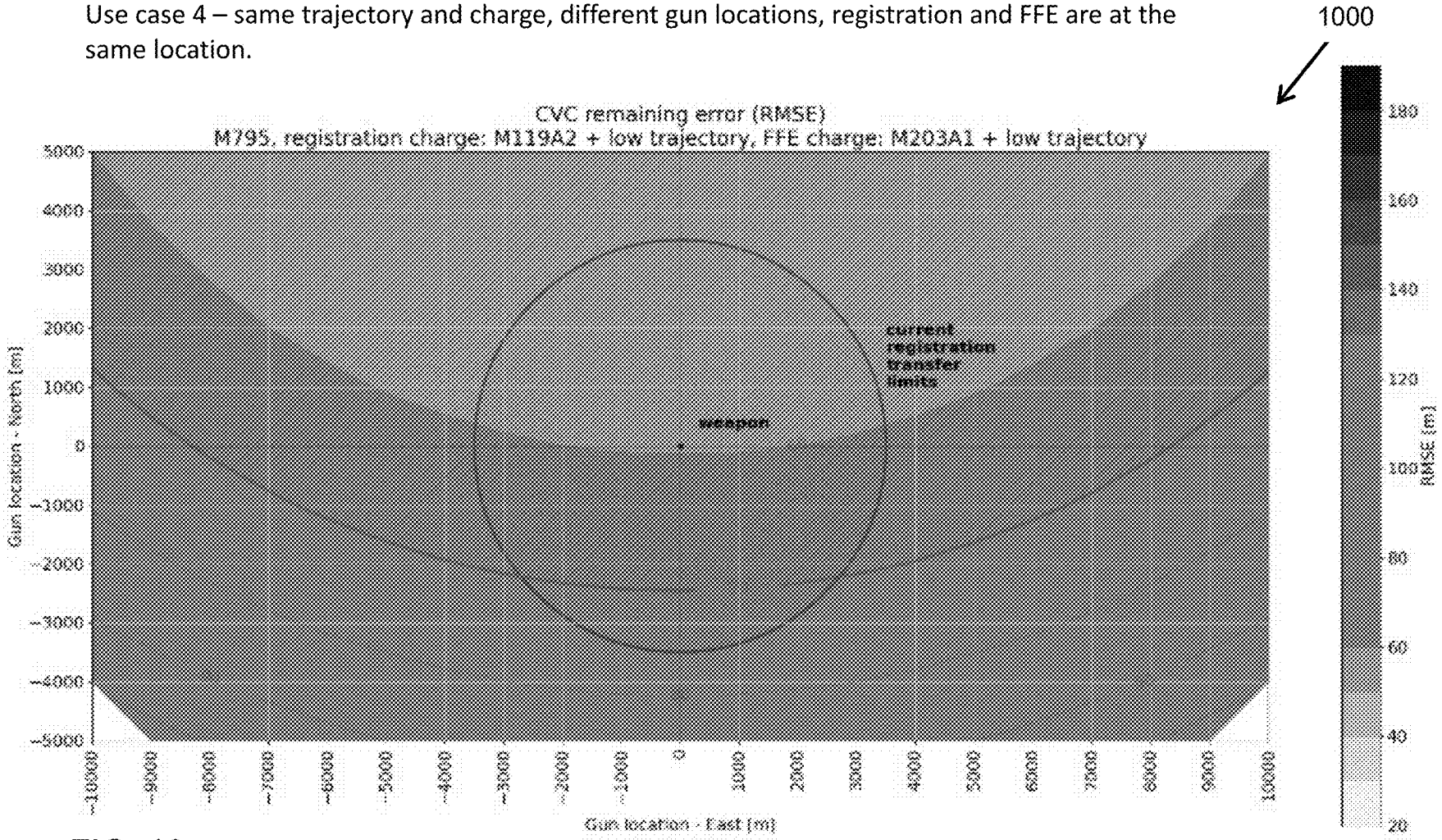
Figure 11:
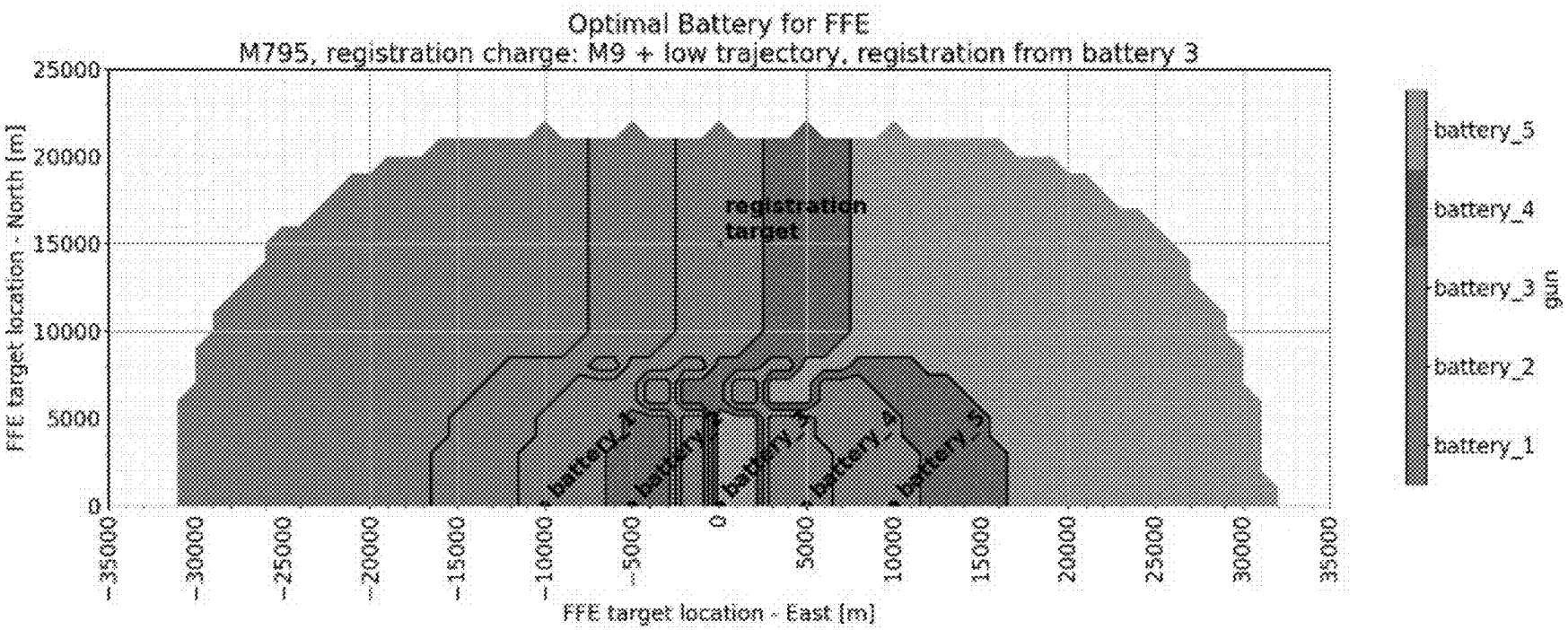
Figure 12:
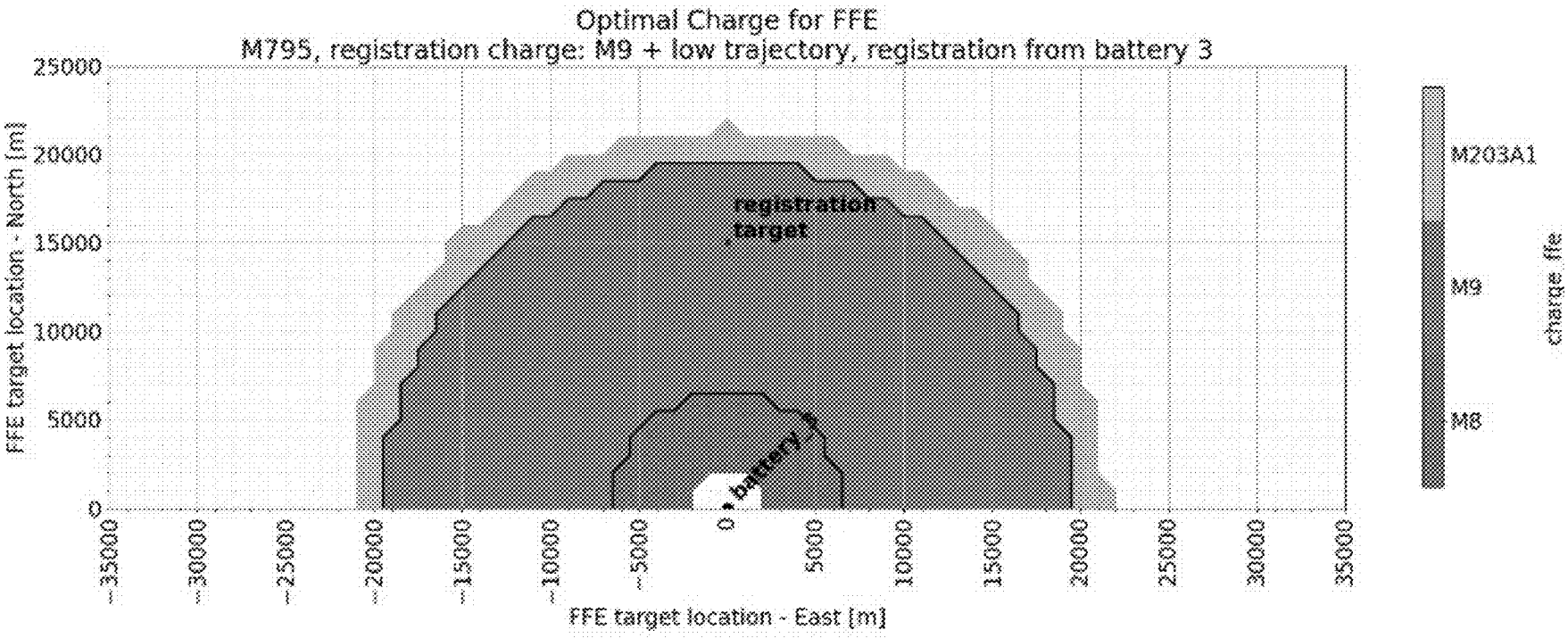

The graphs in FIGS. 8-12 are as follows:

FIG. 8: Use case 1, same trajectory and gun, registration with lower charge, FFE with higher charge. FIG. 9: Use case 2-same charge and gun, registration with high trajectory, FFE with low trajectory FIG. 10: Use case 4-same trajectory and charge, different gun locations, registration and FFE are at the same location. FIG. 11: Use case 7-multiple guns are firing for FFE. FIG. 12: Use case 7-multiple guns are firing for FFE, optimal charge to use for gun (battery) 3 for each FFE target on the grid. Each point on the graph corresponds to a different FFE target and for each such point, a calculation of optimal gun and charge is performed (as explained in paragraph 8.h. above). This figure color codes the optimal gun to use for each FFE target on the grid, assuming the optimal charge for each is selected as well (not shown on this graph).

Figure 13:
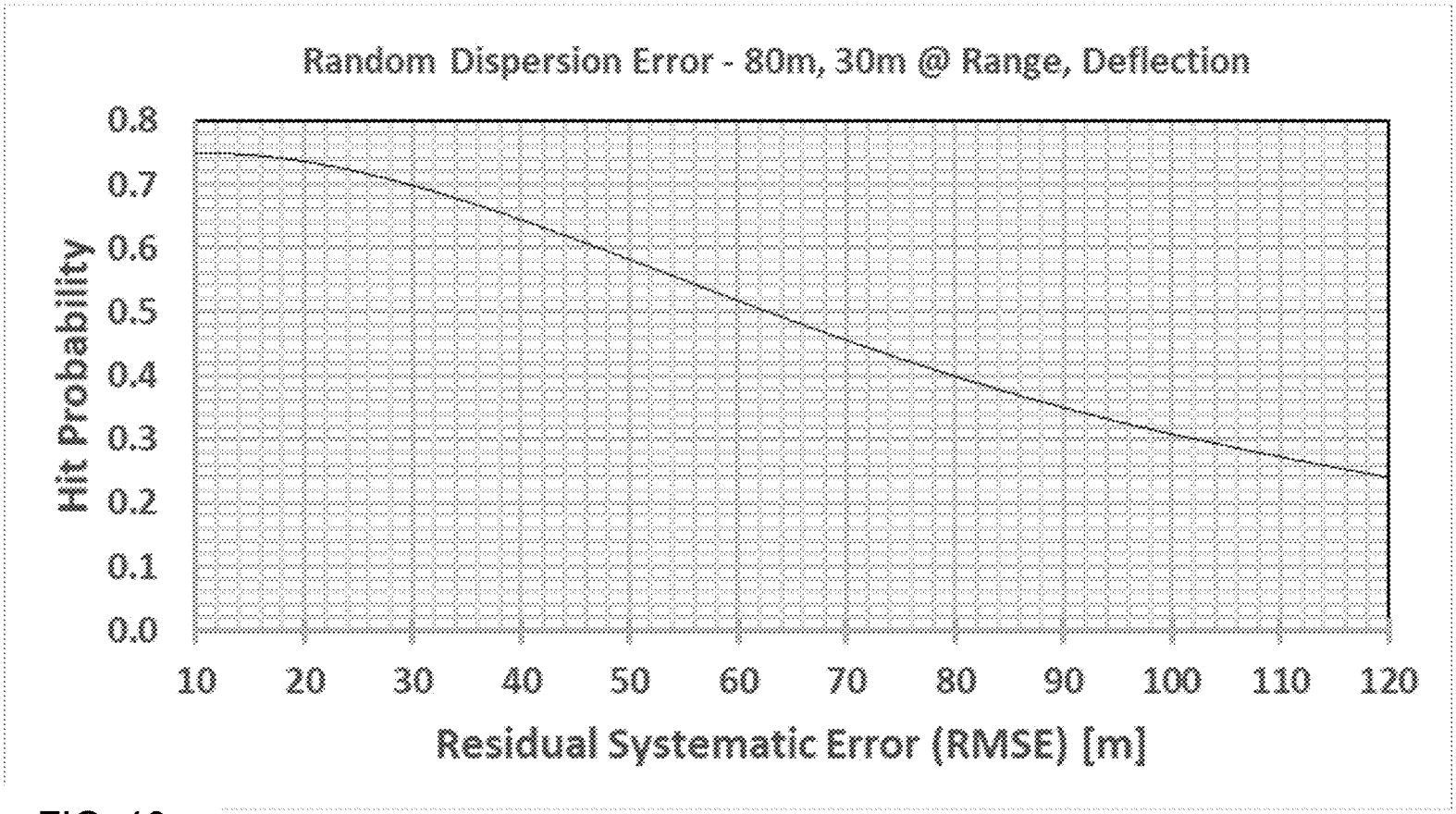
FIG. 13 is a graph of dispersion error, in accordance with an embodiment of the present invention.

FIG. 13 gives a more intuitive interpretation to the numerical values of the residual errors (RMSE) shown in FIGS. 2-5 by estimating a hit probability in a specific scenario.

EXAMPLES

Example one (a first exemplary embodiment of the invention described herein), includes a system configured to perform steps of: 1) acquiring location coordinates of a) a gun to be fired for registration, of b) a registration target, and of c) a fire-for-effect (FFE) target; 2) acquiring values for a set of firing conditions, including gun and/or environmental conditions, for both registration and FFE firing, wherein the set of firing conditions include one or more of projectile mass, ballistic drag and lift coefficients, muzzle velocity, barrel wear, propellant temperature, elevation jump, azimuth jump, wind velocity, air pressure, air temperature; 3) estimating a unit effect of a firing condition error, for each of the firing conditions of the set, and determining correlation terms of an error covariance matrix W, wherein the correlation terms indicate correlations between errors both of registration firing conditions and of FFE firing conditions, and wherein at least one correlation term is less than one and greater than zero; 4) acquiring a registration miss vector as a result of firing the gun for registration firing, wherein elevation and azimuth parameters for registration firing are calculated by a ballistic simulation engine (BSE); 5) generating from the correlation terms of the error covariance matrix W and the unit effects, a) an effects covariance matrix $\Sigma_{12}$ of effect correlations between errors of conditions during registration fire and errors of conditions during FFE, and b) an effects covariance matrix $\Sigma_{22}$ of correlations between errors of conditions during FFE, and responsively calculating a conditional correction matrix $\Sigma_{12}\Sigma_{22}-1$; and 6) multiplying the conditional correction matrix by the registration miss vector to calculate an FFE correction vector for FFE firing.

In an example 2, the system is further configured to subtract the FFE correction vector from the FFE target coordinates to calculate FFE target adjusted coordinates to be entered to the BSE, to generate elevation and azimuth firing parameters for the FFE firing. In an example 3, for any of the above examples, the firing conditions include the muzzle velocity, the registration charge is different than the FFE charge, and the correlation in the error covariance matrix between muzzle velocity error for registration and muzzle velocity error for FFE is less than one and greater than zero. In an example 4, the correlation may be estimated, for example, as approximately 0.5 (e.g., 0.5+/−10%).

In an example 5, any of the above systems is further configured such that the firing conditions include muzzle velocity, the registration gun is be different than the FFE gun, and the correlation in the error covariance matrix between muzzle velocity error for registration and muzzle velocity error for FFE is set to less than one and greater than zero, for example (in an example 6), to approximately 0.5.

In an example 7, any of the above systems is further configured such that the firing conditions include north and east wind velocities, and the registration trajectory is different than the FFE trajectory, such that the correlation between respective wind velocity errors for registration and for FFE is set to less than one and greater than zero, for example, (in an example 8) to a ratio of maximum heights of lower and higher trajectories.

In an example 9, any of the above systems is further configured such that the firing conditions include values for north and east wind velocities, and the correlation of wind velocities for registration and for FFE in the error covariance matrix is set as a function of time to be less than one and greater than zero.

In an example 10, any of the above systems is further configured such that the firing conditions include values for muzzle velocity and north and east wind velocities, and the registration gun, charge, and trajectory may be different than for the FFE, such that the correlation in the error covariance matrix between respective wind velocity errors for registration and for FFE is set to less than one and greater than zero, and the correlation between muzzle velocity errors for registration and for FFE is also set to less than one and greater than zero.

In an example 11, any of the above systems is further configured to calculate a root-mean-square error (RMSE) value for the FFE correction vector, to compare the RMSE value with a pre-set threshold, and to provide output giving a determination (i.e., output) as to whether or not to fire towards the FFE target with the FFE correction vector.

In an example 12, any of the above systems is further configured to calculate a root-mean-square error (RMSE) value for the FFE correction vector, to generate additional FFE correction vectors for alternative firing conditions, calculating RMSE values for each; and providing a recommendation (i.e., output) for firing towards the FFE with the firing conditions that have the lowest RMSE.

Processing elements of the system described herein may be implemented in digital electronic circuitry, or in computer hardware, firmware, software, or in combinations thereof. Such elements can be implemented as a computer program product, tangibly embodied in an information carrier, such as a non-transient, machine-readable storage device, for execution by, or to control the operation of, data processing apparatus, such as a programmable processor, computer, or deployed to be executed on multiple computers at one site or one or more across multiple sites. Memory storage for software and data may include multiple one or more memory units, including one or more types of storage media. Examples of storage media include, but are not limited to, magnetic media, optical media, and integrated circuits such as read-only memory devices (ROM) and random access memory (RAM). Network interface modules may control the sending and receiving of data packets over networks.

Mobile devices may be any computing device permitting user input to interactive applications as described above.

Method steps associated with the system and process can be rearranged and/or one or more such steps can be omitted to achieve the same, or similar, results to those described herein.

It is to be understood that the embodiments described hereinabove are cited by way of example, and that the present invention is not limited to what has been particularly shown and described hereinabove.

The invention claimed is:

1. A computing system for correcting targeting of indirect fire, comprising at least one processor and memory storage communicatively coupled to the processor and storing computer-readable instructions that when executed perform:

1) acquiring location coordinates of a gun to be fired for registration, of a registration target, and of a fire-for-effect (FFE) target;
2) acquiring values for a set of firing conditions, including gun or environmental conditions, for both registration and FFE firing, wherein the set of firing conditions includes one or more of projectile mass, ballistic drag and lift coefficients, muzzle velocity, barrel wear, propellant temperature, elevation jump, azimuth jump, wind velocity, air pressure, and air temperature;
3) estimating a unit effect of a firing condition error, for each of the firing conditions of the set, and determining correlation terms of an error covariance matrix W, wherein the correlation terms indicate correlations between errors both of registration firing conditions and of FFE firing conditions, and wherein at least one correlation term is less than one and greater than zero;
4) acquiring a registration miss vector (v, w) as a result of registration firing, wherein elevation and azimuth parameters for the registration firing are calculated by a ballistic simulation engine (BSE);
5) generating from the correlation terms of the error covariance matrix W and the unit effects, a) an effects covariance matrix $\Sigma_{12}$ of effect correlations between errors of conditions during registration fire and errors of conditions during FFE, and b) an effects covariance matrix $\Sigma_{22}$ of correlations between errors of conditions during FFE, and responsively calculating a conditional correction matrix, $\Sigma_{12}\Sigma_{22}^{-1}$; and
6) multiplying the conditional correction matrix $\Sigma_{12}\Sigma_{22}^{-1}$ by the registration miss vector (v, w) to calculate an FFE correction vector for FFE firing.

2. The computing system of claim 1, further comprising subtracting the FFE correction vector from the FFE target coordinates to calculate FFE target adjusted coordinates to be entered to the BSE to generate elevation and azimuth firing parameters for the FFE firing.

3. The computing system of claim 1, wherein the set of firing conditions includes the muzzle velocity, the registration charge is different than the FFE charge, and the correlation in the error covariance matrix between muzzle velocity error for registration and muzzle velocity error for FFE is less than one and greater than zero.

4. The computing system of claim 3, wherein the correlation between muzzle velocity error for registration and muzzle velocity error for FFE is estimated as approximately 0.5.

5. The computing system of claim 1, wherein the set of firing conditions includes muzzle velocity, and wherein the registration gun is different than the FFE gun, such that a correlation in the error covariance matrix between muzzle velocity error for registration and muzzle velocity error for FFE is set to less than one and greater than zero.

6. The computing system of claim 5, wherein the correlation between muzzle velocity error for registration and muzzle velocity error for FFE is set to approximately 0.5.

7. The computing system of claim 1, wherein the set of firing conditions includes north and east wind velocities, wherein the registration trajectory is different than the FFE trajectory, and the correlation between respective wind velocity errors for registration and for FFE is less than one and greater than zero.

8. The computing system of claim 7, wherein the correlation between each respective wind velocity error for registration and for FFE is set to a ratio of maximum heights of lower and higher trajectories.

9. The computing system of claim 1, wherein the set of firing conditions includes values for north and east wind velocities, wherein the correlation of wind velocities for registration and for FFE in the error covariance matrix is set as a function of a time interval to be less than one and greater than zero.

10. The computing system of claim 1, wherein the set of firing conditions includes muzzle velocity and north and east wind velocities, and wherein the registration gun, charge, and trajectory are different than for the FFE, such that a correlation in the error covariance matrix between respective wind velocity errors for registration and for FFE is set to less than one and greater than zero, and the correlation between muzzle velocity errors for registration and for FFE is also set to less than one and greater than zero.

11. The computing system of claim 1, further comprising calculating a root-mean-square error (RMSE) value for the FFE correction vector, comparing the RMSE value with a pre-set threshold, and responsively providing a determination as to whether to fire towards the FFE target with the FFE correction vector.

12. The computing system of claim 1, further comprising: calculating a root-mean-square error (RMSE) value for the FFE correction vector; generating additional FFE correction vectors for alternative firing conditions, calculating RMSE values for each of the additional FFE correction vectors; and providing a recommendation for firing towards the FFE with the firing conditions that have the lowest RMSE.

13. A method for dynamically correcting targeting of indirect fire comprising steps of:

1) acquiring locations of a gun to be fired for registration, of a registration target, and of a fire-for-effect (FFE) target;
2) acquiring values for a set of firing conditions, including gun and/or environmental conditions, for both registration and FFE firing, wherein the firing conditions include at least one of projectile mass, ballistic drag and lift coefficients, muzzle velocity, barrel wear, propellant temperature, elevation jump, azimuth jump, wind velocity, air pressure, air temperature;
3) estimating a unit effect of a firing condition error, for each of the firing conditions of the set, and determining correlation terms of an error covariance matrix W, wherein the correlation terms indicate correlations between errors both of registration firing conditions and of FFE firing conditions, and wherein at least one correlation term is less than one and greater than zero;

4) acquiring a registration miss vector as a result of registration firing, wherein elevation and azimuth parameters for registration firing are calculated by a ballistic simulation engine (BSE);

5) generating, from the correlation terms of the error covariance matrix W and the unit effects, 1) an effects covariance matrix $\Sigma_{12}$ of effect correlations between errors of conditions during registration fire and errors of conditions during FFE, and 2) an effects covariance matrix $\Sigma_{22}$ of correlations between errors of conditions during FFE, and responsively calculating a conditional correction matrix $\Sigma_{12}\Sigma_{22}^{-1}$ 6) multiplying the conditional correction matrix by the registration miss vector to calculate an FFE correction vector for FFE firing;

7) calculating FFE target adjusted coordinates by subtracting the FFE correction vector from the FFE target coordinates;

8) entering the FFE target adjusted coordinates to the BSE to generate elevation and azimuth firing parameters for FFE firing.

14. The method of claim 13, further comprising planning a different charge for registration and for FFE and responsively setting a correlation of muzzle velocity error for registration and for FFE as less than one and greater than zero in the error covariance matrix.

15. The method of claim 13, further comprising planning a different gun for registration and for FFE and responsively setting a correlation of muzzle velocity error for registration and for FFE as less than one and greater than zero in the error covariance matrix.

16. The method of claim 13, wherein the set of firing conditions includes values for north and east wind velocities, and wherein a time interval between the registration firing and the FFE reduces the statistical correlation, such that a correlation in the error covariance matrix between respective wind velocity errors for registration and for FFE to a value less than one and greater than zero.

17. The method of claim 13, further comprising planning a different trajectory for registration and for FFE and responsively setting correlations of north and east wind velocities, for registration and for FFE, as less than one and greater than zero in the error covariance matrix.

18. The method of claim 17, wherein the correlation between each respective wind velocity error for registration and for FFE is estimated as a weighted ratio of maximum heights of lower and higher trajectories.

19. The method of claim 13, further comprising calculating a root-mean-square error (RMSE) value for the FFE correction vector, comparing the RMSE value with a pre-set threshold to determine whether to fire towards the FFE target with the FFE correction vector.

20. The method of claim 13, further comprising: calculating a root-mean-square error (RMSE) value for the FFE correction vector; generating additional FFE correction vectors for alternative firing conditions; and firing towards the FFE with the firing conditions that have the lowest RMSE.

* * * * *